US007240005B2

(12) United States Patent
Chihara

(10) Patent No.: US 7,240,005 B2
(45) Date of Patent: Jul. 3, 2007

(54) METHOD OF CONTROLLING HIGH-SPEED READING IN A TEXT-TO-SPEECH CONVERSION SYSTEM

(75) Inventor: Keiichi Chihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 502 days.

(21) Appl. No.: 10/058,104

(22) Filed: Jan. 29, 2002

(65) Prior Publication Data

US 2003/0004723 A1 Jan. 2, 2003

(30) Foreign Application Priority Data

Jun. 26, 2001 (JP) ..... 2001-192778

(51) Int. Cl.
*G10L 13/00* (2006.01)
*G10L 13/06* (2006.01)

(52) U.S. Cl. ..... 704/267; 704/258

(58) Field of Classification Search ..... 704/258, 704/267, 266

See application file for complete search history.

(56) References Cited

U.S. PATENT DOCUMENTS 4,279,030 A * 7/1981 Masuzawa et al. ..... 368/63
4,700,393 A * 10/1987 Masuzawa et al. ..... 704/503
5,615,300 A * 3/1997 Hara et al. ..... 704/260
5,749,071 A * 5/1998 Silverman ..... 704/260
5,826,231 A * 10/1998 Vigier ..... 704/262
5,905,972 A * 5/1999 Huang et al. ..... 704/268
5,913,194 A * 6/1999 Karaali et al. ..... 704/259
5,926,788 A * 7/1999 Nishiguchi ..... 704/265
6,101,470 A * 8/2000 Eide et al. ..... 704/260
6,205,427 B1 * 3/2001 Itoh et al. ..... 704/260
6,260,016 B1 * 7/2001 Holm et al. ..... 704/260
6,546,367 B2 * 4/2003 Otsuka ..... 704/260
6,810,379 B1 * 10/2004 Vermeulen et al. ..... 704/260
2003/0014253 A1 * 1/2003 Walsh ..... 704/260

OTHER PUBLICATIONS

Rye, "Speech Synthesis at Higher Speaking Rates", CSUN 1999 Papers, Available at: http://www.dinf.ne.jp/doc/english/Us_Eu/conf/csun_99/session0088.html.*

Yegnanarayana et al., "Voice simulation: factors affecting quality and naturalness", Proceedings of the 22nd conference on Association for Computational Linguistics, pp. 530-533, Year of Publication: 1984.*

Hirschberg et al., "Building Study Skills for Students with Vision Loss", EnVision, vol. 4, No. 4, Fall 1998.*

* cited by examiner

*Primary Examiner*—David R. Hudspeth
*Assistant Examiner*—Brian L. Albertalli
(74) *Attorney, Agent, or Firm*—Takeuchi & Kubotera, LLP

(57) ABSTRACT

A method of high-speed reading in a text-to-speech conversion system including a text analysis module (101) for generating a phoneme and prosody character string from an input text; a prosody generation module (102) for generating a synthesis parameter of at least a voice segment, a phoneme duration, and a fundamental frequency for the phoneme and prosody character string; and a speech generation module (103) for generating a synthetic waveform by waveform superimposition by referring to a voice segment dictionary (105). The prosody generation module is provided with both a duration rule table containing empirically found phoneme durations and a duration prediction table containing phoneme durations predicted by statistical analysis and, when the user-designated utterance speed exceeds a threshold, uses the duration rule table and, when the threshold is not exceeded, uses the duration prediction table to determined the phoneme duration.

16 Claims, 21 Drawing Sheets

(a) NORMAL UTTERANCE SPEED (b) HIGHEST UTTERANCE SPEED (c) UTTERANCE SPEED : LEVEL 1

(b) UTTERANCE SPEED : LEVEL 2

(a) UTTERANCE SPEED : LEVEL 4

METHOD OF CONTROLLING HIGH-SPEED READING IN A TEXT-TO-SPEECH CONVERSION SYSTEM

BACKGROUND OF THE INVENTION

1. Field of the Invention

The present invention relates to text-to-speech conversion technologies for outputting a speech for a text that is composed of Japanese Kanji and Kana characters and, particularly, to a prosody control in high-speed reading.

2. Description of the Related Art

A text-to-speech conversion system, which receives a text composed of Japanese Kanji and Kana characters and converts it to a speech for outputting, is limitless in the output vocabularies and is expected to replace the record/playback speech synthesis technology in a variety of application fields.

FIG. 15 shows a typical text-to-speech conversion system. When a text of sentences composed of Japanese Kanji and Kana characters (hereinafter "text") is inputted, a text analysis module 101 generates a phoneme and prosody character string or sequence from the character information. The "phoneme and prosody character string or sequence" herein used means a sequence of characters representing the reading of an input sentence and the prosodic information such as accent and intonation (hereinafter "intermediate language"). A word dictionary 104 is a pronunciation dictionary in which the reading, accent, etc. of each word are registered. The text analysis module 101 performs a linguistic process, such as morphemic analysis and syntax analysis, by referring to the pronunciation dictionary to generate an intermediate language.

Based on the intermediate language generated by the text analysis module 101, a prosody generation module 102 determines a composite or synthesis parameter composed of a voice segment (kind of a sound), a sound quality conversion coefficient (tone of a sound), a phoneme duration (length of a sound), a phoneme power (intensity of a sound), and a fundamental frequency (loudness of a sound, hereinafter "pitch") and transmits it to a speech generation module 103.

The "voice segments" herein used mean units of voice connected to produce a composite or synthetic waveform (speech) and vary with the kind of sound. Generally, the voice segment is composed of a string of phonemes such as CV, VV, VCV, or CVC wherein C and V represent a consonant and a vowel, respectively.

Based on the respective parameters generated by the prosody generation module 102, the speech generation module 103 generates a composite or synthetic waveform (speech) by referring to a voice segment dictionary 105 that is composed of a read-only memory (ROM), etc., in which voice segments are stored, and outputs the synthetic speech through a speaker. The synthetic speech can be made by, for example, putting a pitch mark (as a reference point) on the voice waveform and, upon synthesis, superimposing it by shifting the position of the pitch mark according to the synthesis pitch cycle. The foregoing is a brief description of the text-to-speech conversion process.

FIG. 16 shows the conventional prosody generation module 102. The intermediate language inputted to the prosody generation module 102 is a phoneme character sequence containing prosodic information such as an accent position and a pause position. Based on this information, the module 102 determines a parameter for generating waveforms (hereinafter "synthesis parameter") such as temporal changes of the pitch (hereinafter "pitch contour"), the voice power, the phoneme duration, and the voice segment addresses stored in a voice segment dictionary. In addition, the user may input a control parameter for designating at least one utterance property such as a utterance speed, pitch, intonation, intensity, speaker, and sound quality.

An intermediate language analysis unit 201 analyzes a character sequence for the input intermediate language to determine a word boundary from the breath group and word end symbols put on the intermediate language and the mora (syllable) position of an accent nuclear from the accent symbol. The "breath group" means a unit of utterance made in a breath. The "accent nuclear" means the position at which the accent falls. A word with the accent nuclear at the first mora is called "accent type one word", a word with the accent nuclear at the n-th mora is called "accent type n word" and, generally, it is called "accent type uneven word". Conversely, a word with no accent nuclear, such as "shinbun" or "pasocon", is called "accent type 0" or "accent type flat" word. The information about such prosody is transmitted to a pitch contour determination unit 202, a phoneme duration determination unit 203, a phoneme power determination unit 204, a voice segment determination unit 205, and a sound quality coefficient determination unit 206, respectively.

The pitch contour determination unit 202 calculates pitch frequency changes in an accent or phrase unit from the prosody information on the intermediate language. The pitch control mechanism model specified by critically damped second-order linear systems, which is called "Fujisaki model", has been used. According to the pitch control mechanism model, the fundamental frequency, which determines the pitch, is generated as follows. The frequency of a glottal oscillation or fundamental frequency is controlled by an impulse command issued every time a phrase is switched and a step command issued whenever the accent goes up or down. The impulse command becomes a gently falling curve from the head to the tail of a sentence (phrase component) because of a delay in the physiological mechanism. The step command becomes a locally very uneven curve (accent component). These components are made models as responses to the critically damped second-order linear systems. The logarithmic fundamental frequency changes are expressed as the sum of these components (hereinafter "intonation component").

FIG. 17 shows the pitch control mechanism model. The log-fundamental frequency, lnFo(t), wherein t is the time, is formulated as follows.

$$\ln F_o(t) = \ln F_{\min} + \sum_{i=1}^{I} A_{pi} G_{pi}(t - T_{oi}) + \sum_{j=1}^{J} A_{aj}\{G_{aj}(t - T_{ij}) - G_{aj}(t - T_{2j})\} \quad (1)$$

wherein Fmin is the minimum frequency (hereinafter "base pitch"), I is the number of phrase commands in the sentence, Api is the amplitude of the i-th phrase command, Toi is the start time of the i-th phrase command, J is the number of accent commands in the sentence, Aaj is the amplitude of the j-th accent command, and T1j and T2j are the start and end times of the j-th accent command, respectively. Gpi(t) and Gaj(t) are the impulse response function of the phrase control mechanism and the step response function of the accent control mechanism, respectively, and given by the following equations.

$$G_{pi}(t)=\alpha_i^2 t\exp(-\alpha_i t) \quad (2)$$

$$G_{aj}(t)=\min[1-(1+\beta_j t)\exp(-\beta_j t),\theta] \quad (3)$$

The above equations are the response functions at t≧0. If t<0, then Gpi(t)=Gaj(t).

In Equation (3), the symbol min[x, y] means that the smaller of x and y is taken, which corresponds to the fact that the accent component of a voice reaches the upper limit in a finite time. αi is the natural angular frequency of the phrase control mechanism for the i-th phrase command and, for example, set at 3.0. βj is the natural angular frequency of the accent control mechanism for the j-th accent command and, for example, set at 20.0. θ is the upper limit of the accent component and, for example, set at 0.9.

The units of the fundamental frequency and pitch control parameters, Api, Aaj, Toi, T1j, T2j, αi, βj, and Fmin, are defined as follows. The unit of Fo(t) and Fmin is Hz, the unit of Toi, T1j, and T2j is sec, and the unit of αi and βj is rad/sec. The unit of Api and Aaj is derived from the above units of the fundamental frequency and pitch control parameters.

The pitch contour determination unit 202 determines the pitch control parameter from the intermediate language. For example, the start time of a phrase command, Toi, is set at the position of a punctuation on the intermediate language, the start time of an accent command, T1j, is set immediately after the word boundary symbol, and the end time of the accent command, T2j, is set at either the position of the accent symbol or immediately before the word boundary symbol for an accent type flat word with no accent symbol. The amplitudes of phrase and accent commands, Api and Aaj, are determined in most cases by statistical analysis such as Quantification theory (type one), which is well known and its description will be omitted.

FIG. 18 shows the pitch contour generation process. The analysis result generated by the intermediate language analysis unit 201 is sent to a control factor setting section 501, where control factors required to predict the amplitudes of phrase and accent components are set. The information necessary for phrase component prediction, such as the number of moras in the phrase, the position within the sentence, and the accent type of the leading word, is sent to a phrase component estimation section 503. The information necessary for accent component prediction, such as the accent type of the accented phrase, the number of moras, the part of speech, and the position in the phrase, is sent to an accent component estimation section 502. The prediction of respective component values uses a prediction table 506 that has been trained by using statistical analysis, such as Quantification theory (type one), based on the natural utterance data.

The predicted results are sent to a pitch contour correction section 504, in which the estimated values Api and Aaj are corrected when the user designates the intonation. This control function is used to emphasize or suppress the word in the sentence. Usually, the intonation is controlled at three to five levels by multiplying each level with a predetermined constant. Where there is no intonation designation, no correction is made.

After both the phrase and accent component values are corrected, they are sent to a base pitch addition section 505 to generate a sequence of data according to Equation (1). Based on user's pitch designation, data for the designated level is retrieved as a base pitch from a base pitch table 507 for making addition. The logarithmic base pitch, lnFmin, represents the minimum pitch of a synthetic voice and is used to control the pitch of a voice. Usually, lnFmin is quantized at five to 10 levels and stored in the table. It is increased where the user desires overall loud voices. Conversely, it is lowered when soft voices are desired.

The base pitch table 507 is divided into two sections; one for men's voice and the other for women's voice. Based on user's speaker designation, the base pitch is selected for retrieval. Usually, men's voice is quantized at pitch levels between 3.0 and 4.0 while women's voice is at pitch levels between 4.0 and 5.0.

The phoneme duration control will be described. The phoneme duration determination unit 203 determines the phoneme length and the pause length from the phoneme character string and the prosodic symbol. The "pause length" means the length between phrases or sentences. The phoneme length determines the length of consonant and/or vowel which constitute a syllable and the silent length between closed sections that occurs immediately before a plosive phoneme such as p, t, or k. The phoneme duration and pause lengths are called generally "duration length". The phoneme duration is determined by statistical analysis, such as Quantification theory (type one), based on the kind of phonemes adjacent to the target phoneme or the syllable position in the word or breath group. The pause length is determined by statistical analysis, such as Quantification theory (type one), based on the number of moras in adjacent phrases. Where the user designates the utterance speed, the phoneme duration is adjusted accordingly. Usually, the utterance speed is controlled at five to 10 levels by multiplying each level by a predetermined constant. When slow utterance is desired, the phoneme duration is lengthened while the phoneme duration is shortened for high utterance speed. The phoneme duration control is the subject matter of this application and will be described later.

The phoneme power determination unit 204 calculates the waveform amplitudes of individual phonemes from a phoneme character string. The waveform amplitudes are determined empirically from the kind of a phoneme, such as a, i, u, e, or o, and the syllable position in the breath group. The power transition within the syllable is also determined from the rising period when the amplitude gradually increases to the falling period when the amplitude decreases through the stationary-state period. The power control is made by using the coefficient table. When the user designates the intensity, the amplitude is adjusted accordingly. The intensity is controlled usually at 10 levels by multiplying each level by a predetermined constant.

The voice segment determination unit 205 determines the addresses, within the voice segment dictionary 105, of voice segments required to express a phoneme character string. The voice dictionary 105 contains voice segments of a plurality of speakers including both men and women and determines the address of a voice segment according to user's speaker designation. The voice segment data in the dictionary 105 is composed of various units corresponding to the adjacent phoneme environment, such as CV or VCV, so that the optimum synthesis unit is selected from the phoneme character string of an input text.

The sound quality determination unit 206 determines the conversion parameter when the user makes a sound quality conversion designation. The "sound quality conversion" means the process of signals for the voice segment data stored in the dictionary 105 so that the voice segment data is treated as the voice segment data of another speaker. Generally, it is achieved by linearly expanding or compressing the voice segment data. The expansion process is made by oversampling the voice segment data, resulting in the deep voice. Conversely, the compression process is made by downsampling the voice segment data, resulting in the thin voice. The sound quality conversion is controlled usually at five to 10 levels, each of which has been assigned with a re-sampling rate.

The pitch contour, phoneme power, phoneme duration, voice segment address, and expansion/compression parameters are sent to the synthesis parameter generation unit 207 to provide a synthesis parameter. The synthesis parameter is used to generate a waveform in a frame unit of 8 ms, for example, and sent to the waveform (speech) generation module 103.

FIG. 19 shows the speech generation process. A voice segment decoder 301 loads voice segment data from the voice segment dictionary 105 with a voice segment address of the synthesis parameter as a reference pointer and, if necessary, processes the signal. If a compression process has been applied to the dictionary 105, which contains voice segment data for voice synthesis, a decoding process is applied to the dictionary 105. The decoded voice segment data is multiplied by an amplitude coefficient in an amplitude controller 302 for making power control. The expansion/compression process of a voice segment is made in a voice segment processor 303 for making voice conversion. When a deep voice is desired, the voice segment is expanded and, when a thin voice is desired, the voice segment is compressed. In a superimposition controller 304, superimposition of the segment data is controlled according to the information such as the pitch contour and phoneme duration to generate a synthetic waveform. The superimposed data is written sequentially into a digital/analog (D/A) ring buffer 305 and transferred to a D/A converter with an output sampling cycle for output from a speaker.

FIG. 20 shows the phoneme duration determination process. The intermediate language analysis unit 201 feeds the analysis result into a control factor setting section 601, where the control factors required to predict the duration length of each phoneme or word are set. The prediction uses pieces of information such as the phoneme, the kind of adjacent phonemes, the number of moras in the phrase, and the position in the sentence, which are sent to a duration estimation section 602. The prediction of each of the accent and phrase component values uses a duration prediction table 604 that has been trained by using statistical analysis, such as Quantification theory (type one), based on the natural utterance data. The predicted result is sent to a duration correcting section 603 to correct the predicted value where the user designates the utterance speed. The utterance speed designation is controlled at five to 10 levels by multiplying each level by a predetermined constant. When a low utterance speed is desired, the phoneme duration is increased and, when a high utterance speed is desired, the phoneme duration is decreased. Suppose that there are five utterance speed levels and that Level 0 to Level 4 may be designated. A constant Tn for Level n is set as follows:

$$T_0=2.0,\ T_1=1.5,\ T_2=1.0,\ T_3=0.75,\ \text{and}\ T_4=0.5$$

Among the predicted phoneme durations, the vowel and pause lengths are multiplied by the constant Tn for the level n that is designated by the user. For Level 0, they are multiplied by 2.0 so that the generated waveform is lengthened while the utterance speed is shortened. For Level 4, they are multiplied by 0.5 so that the generated waveform is shortened and the utterance speed is raised. In the above example, Level 2 is made the normal utterance speed (default).

FIG. 21 shows synthetic waveforms to which the utterance speed control has been applied. The utterance speed control of a phoneme duration is made only for the vowel. The length between closed sections or of a consonant is considered almost constant regardless of the utterance speed. In Graph (a) at a high utterance speed, only the vowel is multiplied by 0.5 and the number of superimposed voice segments is subtracted to make the waveform. Conversely, in Graph (c) at a low utterance speed, only the vowel is multiplied by 1.5 and the number of superimposed voice segment is repeated for making the waveform. Regarding the pause length, the constant for the designated level is multiplied so that the lower the utterance speed, the longer the pause length while the higher the utterance speed, the shorter the pause length.

Let consider the case of a high utterance speed, which corresponds to Level 4 in the above example. In the text-to-speech conversion system, the maximum utterance speed means "Fast Reading Function (FRF)". In the text, there are both important and not-so important portions for the user so that the not-so important portion is read at a high utterance speed and the important portion is read at the normal utterance speed for synthetic speech. Most of all latest model has such an FRF button. When this button is held down, the utterance speed is set at the maximum level for synthesizing a speech at the highest utterance speed and, when the button is released, the utterance speed is returned to the previous level.

The above technology, however, has the following disadvantages.

(A) When FRF is turned on, merely the phoneme duration is decreased. In other words, the length of a generated waveform is reduced so that an additional load is applied to the speech generation module. In the speech generation module, the speech data generated upon waveform superimposition is written sequentially into the D/A ring buffer. Consequently, if the waveform length is small, the time for waveform generation becomes short. When the waveform data length becomes a half, the process time must be made a half. If the phoneme duration length becomes a half, the calculation amount does not necessarily becomes a half so that the "voice interruption" phenomenon, in which the synthetic voice stops before completion, can take place where the waveform generation cannot keep up with the transfer to the D/A converter.

(B) Also, the pitch contour is compressed linearly. That is, the intonation changes at shorter cycles and the synthetic voice is so unnatural that it is hard to understand. FRF is used not to skip the text but read it fast so that it is not suitable for the synthetic voice that has a very uneven intonation. The intonation of a speech synthesized with FRF changes so violently that the speech is difficult to understand.

(C) In addition, the pause between sentences is compressed with the same rate as the rate for the phoneme duration so that the boundary between sentences becomes too vague to distinguish. Synthetic speeches are outputted rapidly one after another so that the speeches synthesized with FRF are not suitable for understanding the text contents.

(D) Moreover, the utterance speed becomes high over the entire text so that it is difficult to time releasing FRF. The ordinary FRF reads the not-so important portion at high speeds and synthesizes a speech at the normal speed for the important portion of a text. When the user releases the FRF button, a considerable part of the desired portion has been read already. This makes it necessary to reset the reading section before starting speech synthesis at the normal utterance speed. In order to turn on or off FRF, the user must make great efforts in sorting out the necessary portion from the unnecessary one by listening to the unclear speech.

Accordingly, it is an object of the invention to provide a method of controlling the fast reading function (FRF) in a text-to-speech conversion system capable of solving the above problems (A) through (D).

In order to solve the problem (A), according to an aspect of the invention, when the utterance speed is designated at the maximum speed or FRF is turned on, the phoneme duration and the pitch contour are determined in the phoneme duration and pitch contour determination units, respectively, of the prosody generation module by replacing the duration prediction table predicted by statistical analysis with the duration rule table that has been found from experience and such a sound quality conversion coefficient as to keep the sound quality is selected in the sound quality determination unit.

In order to solve the problem (B), according to another aspect of the invention, when the utterance speed is designated at the maximum speed, neither calculation of the accent and phrase components nor change of the base pitch are made.

In order to solve the problem (C), according to still another aspect of the invention, when the utterance speed is designated at the maximum speed, a signal sound is inserted between sentences.

In order to solve the problem (D), according to yet another aspect of the invention, when the utterance speed is designated at the maximum speed, at least the leading word of a sentence is read at the normal utterance speed.

DESCRIPTION OF THE PREFERRED EMBODIMENTS

First Embodiment

The first embodiment is different from the conventional system in that when the utterance speed is set at the maximum level or Fast Reading Function (FRF) is turned on, part of the inside process is simplified or omitted to reduce the load.

Figure 1:
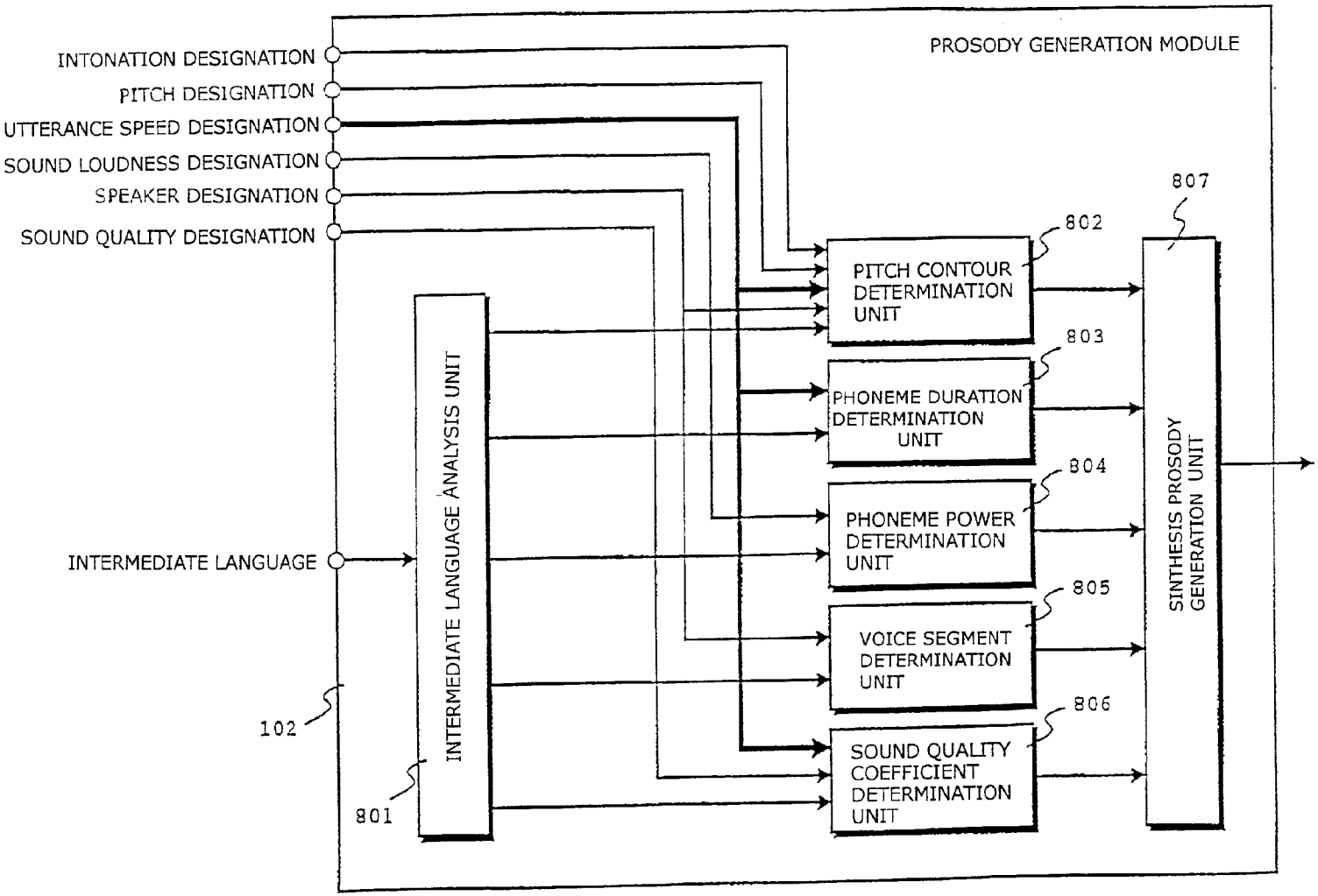
FIG. 1 is a block diagram of a prosody generation module according to the first embodiment of the invention.

In FIG. 1, a prosody generation module 102 receives the intermediate language from the text analysis module 101 identical with the conventional one and the prosody control parameters designated by the user. An intermediate language analysis unit 801 receives the intermediate language sentence by sentence and outputs the analysis results, such as the phoneme string, phrase, and accent information, to a pitch contour determination unit 802, a phoneme duration determination unit 803, a phoneme power determination unit 804, a voice segment determination unit 805, and a sound quality coefficient determination unit 806, respectively.

In addition to the analysis results, the pitch contour determination unit 802 receives each of the intonation, pitch, speed, and speaker designated by the user and outputs a pitch contour a synthesis parameter (prosody) generation unit 807. The "pitch contour" herein used means temporal changes of the fundamental frequency.

In addition to the analysis results, the phoneme duration determination unit 803 receives the utterance speed parameter designated by the user and outputs the phoneme duration and pause length data to the synthesis parameter generation unit 807.

In addition to the analysis results, the phoneme power determination unit 804 receives the voice intensity parameter designated by the user and outputs the phoneme amplitude coefficient to the synthesis parameter generation unit 807.

In addition to the analysis results, the voice segment determination unit 805 receives the speaker parameter designated by the user and outputs the voice segment address required for waveform superimposition to the synthesis parameter generation unit 807.

In addition to the analysis results, the sound quality coefficient determination unit 806 receives each of the sound quality and utterance speed parameters designated by the user and outputs the sound quality conversion parameter to the synthesis parameter generation unit 807.

Based on the input prosodic parameters, such as the pitch contour, phoneme duration, pause length, phoneme amplitude coefficient, voice segment address, and sound quality conversion coefficient, the synthesis parameter generation unit 807 generates and outputs a waveform generating parameter in a frame unit of, for example, 8 ms to the speech generation module 103.

The prosody generation module 102 is different from the convention not only in that the utterance speed designating parameter is inputted to the pitch contour determination unit 802 and the sound quality coefficient determination unit 806 as well as the phoneme duration determination unit 803 but also in terms of the inside process of each of the pitch contour determination unit 802, the phoneme duration determination 803, and the sound quality coefficient determination unit 806. The text analysis module 101 and the speech generation module 103 are the same as the conventions and, therefore, the description of their structure will be omitted.

Figure 2:
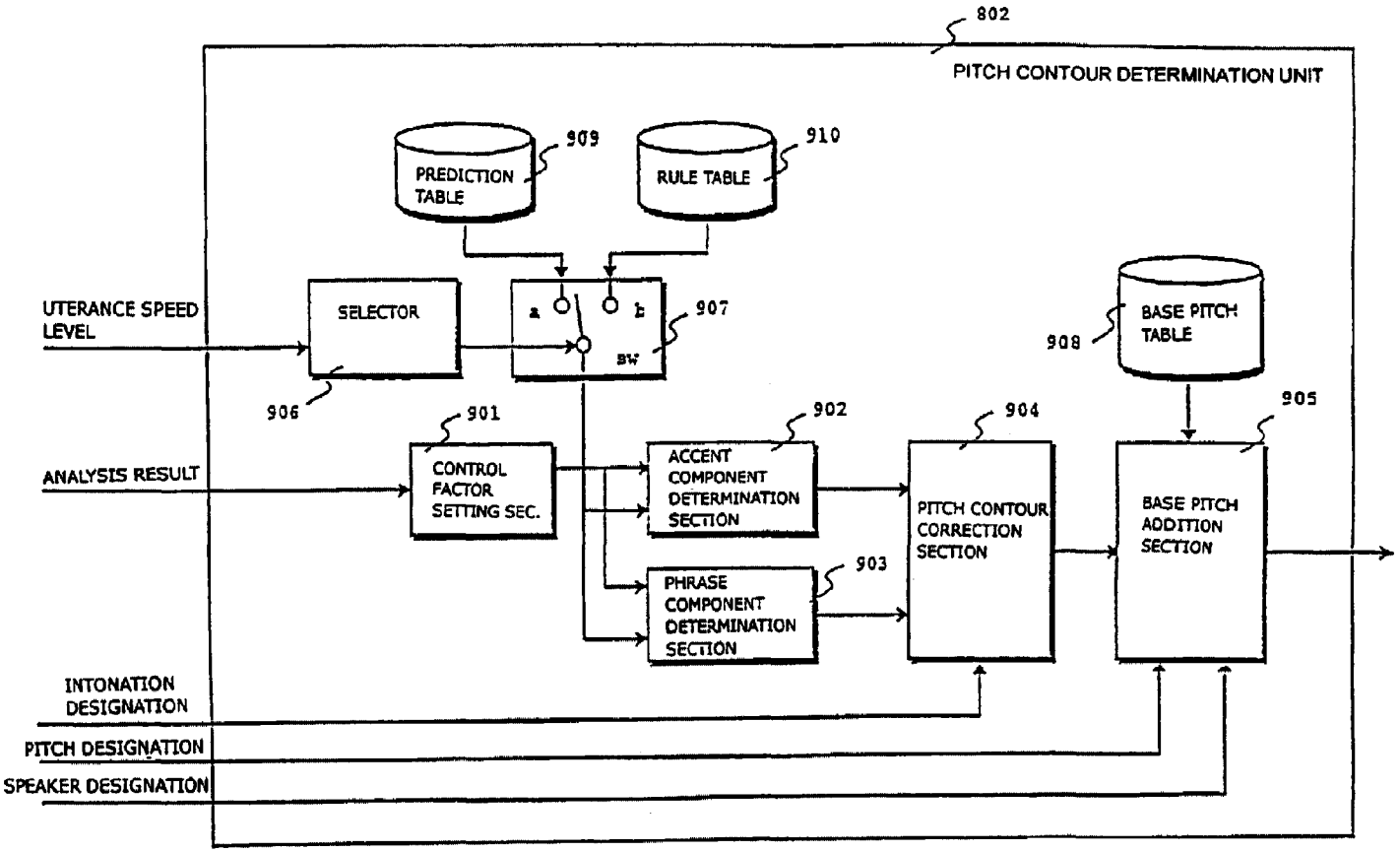
FIG. 2 is a block diagram of a pitch contour determination unit for the prosody generation module.

In FIG. 2, the accent and phrase components are determined by either statistical analysis, such as Quantification theory (type one), or rule. The control by rule uses a rule table 910 that has been made empirically while the control by statistical analysis uses a prediction table 909 that has been trained by using statistical analysis, such as Quantification theory (type one), based on the natural utterance data. The data output of the prediction table 909 is connected to a terminal (a) of a switch 907 while the data output of the rule table 910 is connected to a terminal (b) of the switch 907. The output of a selector 906 determines which terminal (a) or (b) is used.

The utterance speed level designated by the user is inputted to the selector 906, and the output is connected to the switch 907 for controlling the switch 907. When the utterance speed is at the highest level, the output signal is connected to the terminal (b) while, otherwise, it is connected to the terminal (a). The output of the switch 907 is connected to the accent component determination section 902 and the phrase component determination section 903.

The output of the intermediate language analysis section 801 is inputted to a control factor setting section 901 to analyze the factor parameters for the accent and phrase component determination, and the output is connected to the accent component determination section 902 and the phrase component determination section 903.

The accent and phrase component determination sections 902 and 903 receive the output of the switch 907 and use the prediction or rule table 909 or 910 to determine and output respective component values to a pitch contour correction section 904. In the pitch contour correction section 904 to which the intonation level designated by the user has been inputted, they are multiplied by a constant predetermined according to the level, and the results are inputted to a base pitch adding section 905.

Also, the pitch level designated by the user, the speaker designation, and a base pitch table 908 are connected to the base pitch addition section 905. The addition section 905 adds to the input from the pitch contour correction section 904 the constant value predetermined according to the user-designated pitch level and the sex and stored in the base pitch table 908 and outputs a pitch contour sequence data to a synthesis parameter generation unit 807.

Figure 3:
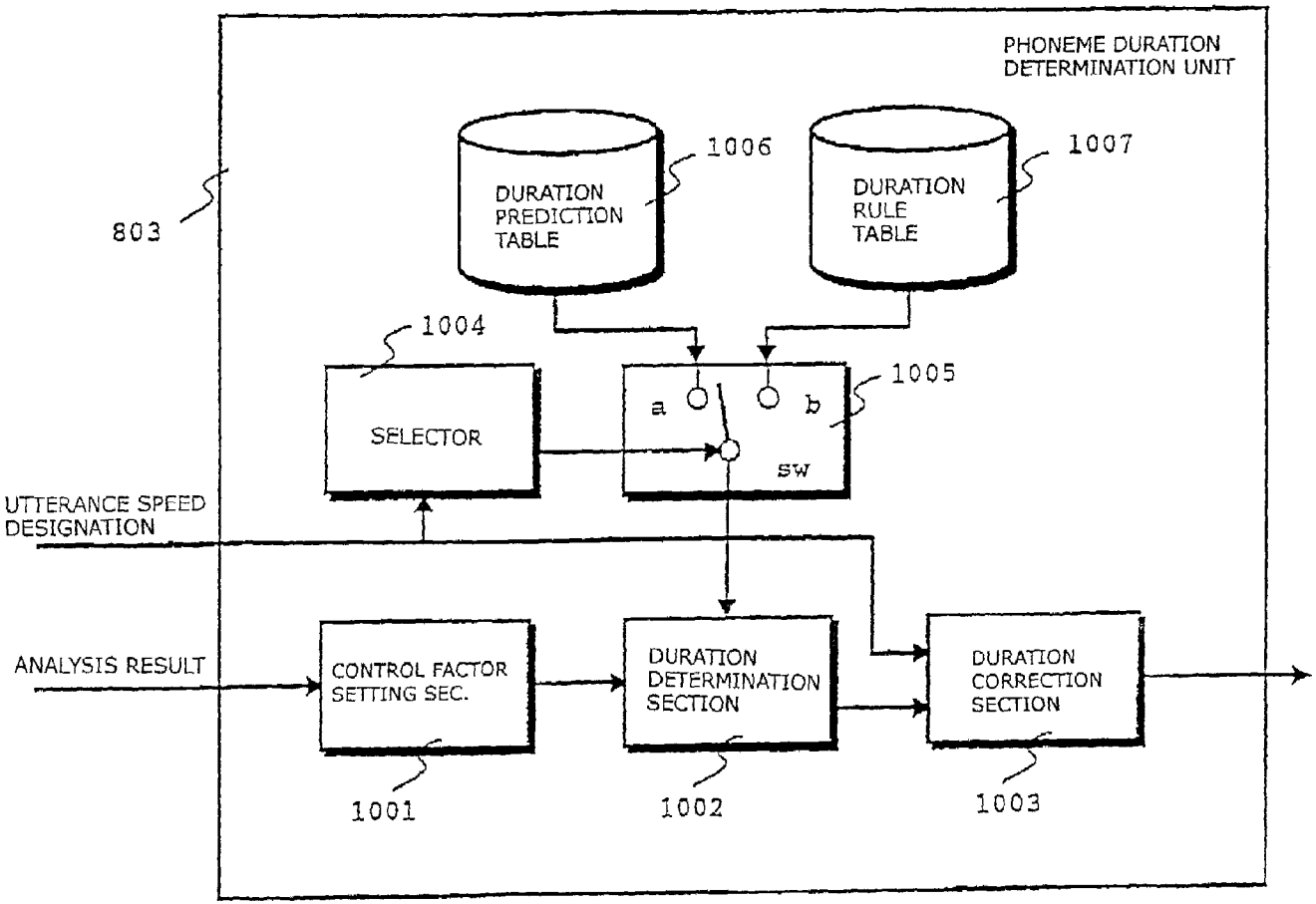
FIG. 3 is a block diagram of a phoneme duration determination unit for the prosody generation module.

In FIG. 3, the phoneme duration is determined by either statistical analysis, such as Quantification theory (type one), or rule. The control by rule uses a duration rule table 1007 that has been made empirically. The control by statistical analysis uses a duration prediction table 1006 that has been trained by statistical analysis, such as Quantification theory (type one), based on natural utterance data. The data output of the duration prediction table 1006 is connected to the terminal (a) of a switch 1005 while the output data of the duration rule table 1007 is connected to the terminal (b). The output of a selector 1004 determines which terminal is used.

The selector 1004 receives the utterance speed designated by the user and feeds the switch 1005 with a signal for controlling the switch 1005. When the utterance speed is at the highest level, the switch 1005 selects the terminal (b) and, otherwise, the terminal (a). The output of the switch 1005 is connected to a duration determination section 1002.

The control factor setting section 1001 receives the output of the intermediate language analysis unit 801, analyzes the factor parameters for phoneme duration determination, and feeds its output to the duration determination section 1002.

The duration determination section 1002 receives the output of the switch 1005, determines the phoneme duration length using the duration prediction table 1006 or duration rule table 1007, and feeds it to a duration correction section 1003. The duration correction section 1003 also receives the utterance speed level designated by the user, multiplies the phoneme duration length by a constant predetermined according to the level for making correction, and feeds the result to the synthesis parameter generation unit 807.

Figure 4:
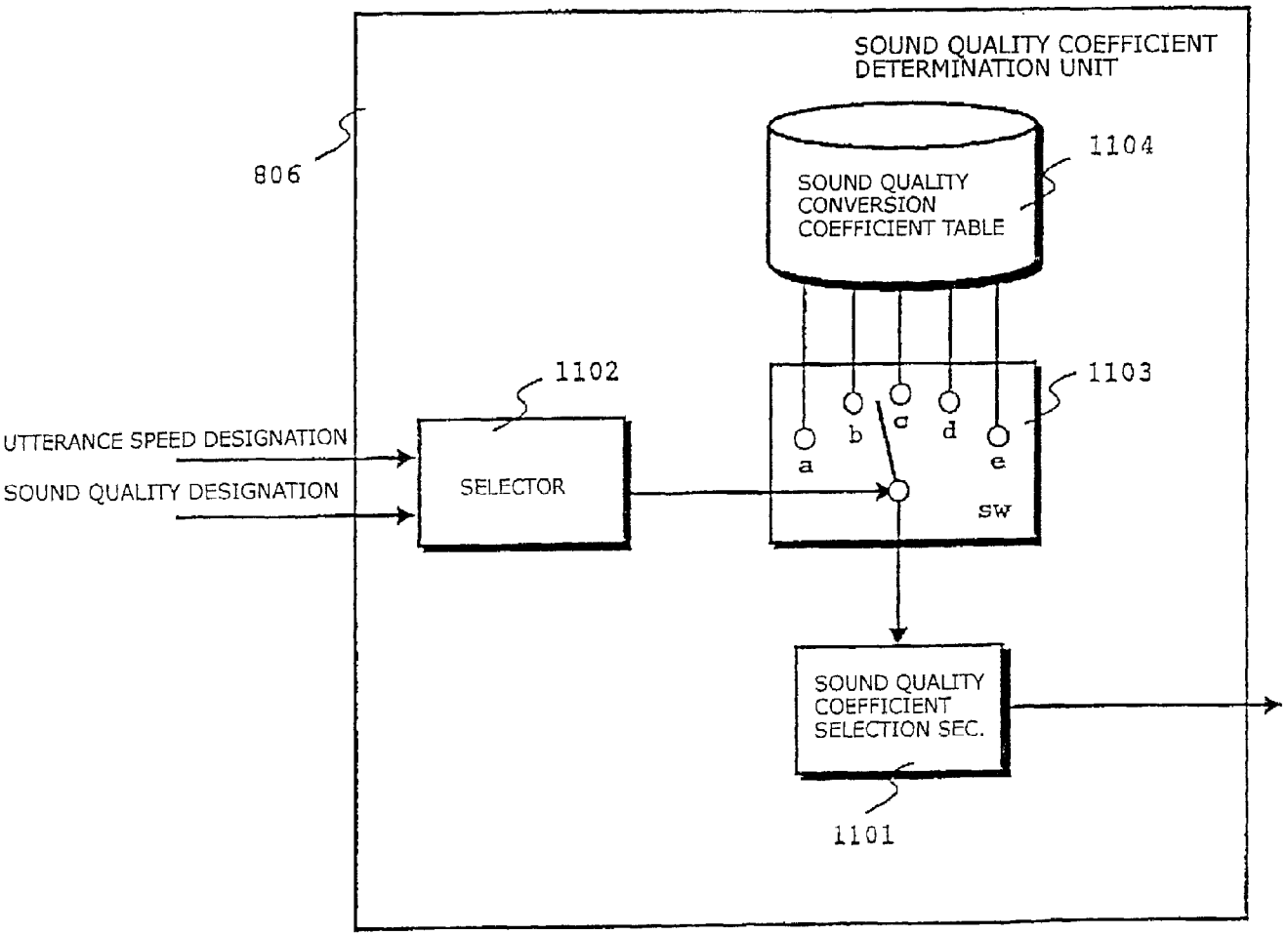
FIG. 4 is a block diagram of a sound quality coefficient determination unit for the prosody generation module.

In FIG. 4, the sound quality conversion is designated at five levels. A selector 1102 receives the utterance speed and sound quality levels designated by the user and feeds a switch 1103 with a signal for controlling the switch 1103. The control signal turns on a terminal (c) unconditionally where the utterance speed is at the highest level and, otherwise, the terminal corresponding to the designated sound quality level. That is, the terminals (a), (b), (c), (d), or (e) is connected at the sound quality Level 0, 1, 2, 3, or 4, respectively. The respective terminals (a)–(e) are connected to a sound quality conversion coefficient table 1104 so that a corresponding sound quality coefficient data is outputted to a sound quality coefficient selection section 1101. The sound quality coefficient selection section 1101 feeds the sound quality conversion coefficient to the synthesis parameter generation unit 807.

In operation, only the parameter (prosody) generation process is different from the convention and, therefore, description of the other processes will be omitted.

The intermediate language generated by the text analysis module 101 is sent to the intermediate language analysis unit 801 of the prosody generation module 102. The intermediate language analysis unit 801 extracts the data required for prosody generation from the phrase end symbol, word end symbol, accent symbol indicative of the accent nuclear, and the phoneme character string and sends it to the pitch contour determination unit 802, phoneme duration determination unit 803, phoneme power determination unit 804, voice segment determination unit 805, and sound quality coefficient determination unit 806, respectively.

The pitch contour determination unit 802 generates an intonation indicating pitch changes, the phoneme duration determination unit 803 determines the pause length inserted between phrases or sentences as well as the phoneme duration. The phoneme power determination unit 804 generates a phoneme power indicating changes in the amplitude of a voice waveform. The voice segment determination unit 805 determines the address, in the voice segment dictionary 105, of a voice segment required for a synthetic waveform generation. The sound quality coefficient determination unit 806 determines a parameter for processing the signal of voice segment data. Of the prosody control designations made by the user, the intonation and pitch designations are sent to the pitch contour determination unit 802. The utterance speed designation is sent to the pitch contour, phoneme duration, and sound quality coefficient determination units 802, 803, and 806, respectively. The intensity designation is sent to the voice power determination unit 804, and the speaker designation is sent to the pitch contour and voice segment determination units 802 and 805, respectively, and the sound quality designation is sent to the sound quality coefficient determination unit 806.

Referring back to FIG. 2, the operation of the pitch contour determination unit 802 will be described. The analysis result of the intermediate language analysis unit 201 is inputted to the control factor setting section 901. The setting section 901 sets control factors required for determining the amplitudes of phrase and accent components. The data required for determining the amplitude of a phrase component is such information as the number of moras of a phrase, relative position in the sentence, and accent type of the leading word. The data required for determining the amplitude of an accent component is such information as the accent type of an accent phrase, the number of total moras, part of the speech, and relative position in the phrase. The value of such a component is determined by using the prediction table 909 or rule table 910. The prediction table 909 has been trained by using statistical analysis, such as Quantification theory (type one), based on natural utterance data while the rule table 910 contains component values found from preparatory experiments. Quantification theory (type one) is will known and, therefore, its description will be omitted. When the output of the switch 907 is connected to the terminal (a), the prediction table 909 is selected while, when the output of the switch 909 is connected to the terminal (b), the rule table 910 is selected.

The utterance speed level designated by the user is inputted to the pitch contour determination unit 802 to actuate the switch 907 via the selector 906. When the input utterance speed is at the highest level, the selector 906 feeds the switch 907 with a control signal for selecting the terminal (b). Conversely, if the input utterance speed is not at the highest level, it feeds the switch 907 with a control signal for selecting the terminal (a). For example, where the utterance speed is able to set at five levels from Level 0 to Level 4 wherein the larger the number, the higher the utterance speed, only when the input utterance speed is set at Level 4, the selector 906 feeds the switch 907 with a control signal for selecting the terminal (b) and, otherwise, selecting the terminal (a). That is, when the utterance speed is set at the highest level, the rule table 910 is selected and, otherwise, the prediction table 909 is selected.

The accent and phrase component determination sections 902 and 903 calculate the respective component vales using the selected table. When the prediction table 909 is selected, the amplitudes of both the accent and phrase components are determined by statistical analysis. Where the rule table 910 is selected, the amplitudes of the accent and phrase components are determined according to the predetermined rule. For example, the phrase component amplitude is determined by the position in the sentence. The leading, tailing, and intermediate phrase components of a sentence are assigned with respective values 0.3, 0.1, and 0.2, respectively. The accent component amplitude is assigned with a component value for each of such conditions whether the accent type is type one or not and whether the word is at the leading position in the phrase or not. This makes it possible to determine both the phrase and accent component values merely by looking up the table. The subject matter of the present application is to provide the contour determination unit with a mode that requires a smaller process amount and a shorter process time than those of the statistical analysis so that the rule making procedure is not limited to the above technique.

The intonation of the accent and phrase components is controlled in the pitch contour correction unit 904, and the pitch control is made in the base pitch addition unit 905. In the pitch contour correction unit 904, the coefficient at the intonation level designated by the user is multiplied. The intonation control designation is made at three levels, for example. That is, the intonation is multiplied by 1.5 at Level 1, 1.0 at Level 2, and 0.5 at Level 3.

In the base pitch addition unit 905, the constant according to the pitch or speaker (sex) designated by the user is added to the accent and phrase components, respectively, to output pitch contour sequence data to the synthesis parameter generation unit 807. For example, in the system where the voice pitch is able to set at five levels from Level 0 to Level 4, wherein usual numbers are 3.0, 3,2, 3,4, 3,6, and 3.8 for the male voice and 4.0, 4.2, 4.4, 4.6, and 4.8 for the female voice.

In FIG. 3, the analysis result is inputted from the intermediate language analysis module 201 to the control factor setting unit 1001, where the control factors required to determine the phoneme duration (consonant, vowel, and closed section) and pause lengths. The data required to determine the phoneme duration include the type of the phoneme or phonemes adjacent the phrase, or the syllable position in the word or breath group. The data required for determining the pause length is the number of moras in adjacent phrases. The duration prediction or rule table 1006 or 1007 is used to determine these duration lengths. The duration prediction table 1006 has been trained by statistical analysis, such as Quantification theory (type one), based on natural utterance data. The duration rule table 1007 stores component values learned from preparatory experiments. The use of these tables is controlled by the switch 1005. When the terminal (a) is connected to the output of the switch 1005, the duration prediction table 1006 is selected while the terminal (b) is connected, the duration rule table 1007 is selected.

The user-designated utterance speed level, which has been inputted to the phoneme duration determination unit 803, actuates the switch 1005 via the selector 1004. When the input utterance speed level is at the maximum speed, a control signal for connecting the terminal (b) is outputted from the selector 1004. Conversely, when the input utterance speed is not at the maximum level, a control signal for connecting the terminal (a) is outputted.

The selected table is used in the duration determination unit 1002 to calculate the phoneme duration and pause lengths. When the duration prediction table 1006 is selected, statistical analysis is employed. When the duration rule table 1007 is selected, determination is made by the predetermined rule. For the phoneme duration rule, for example, a fundamental length is assigned according to the type of phoneme or the position in the sentence. The average value of a large amount of natural utterance data for each phoneme may be made the fundamental length. The pause length is either set at 300 ms or made so as to be determined only by referring to the table. The subject matter of the present application is to provide the phoneme duration determination unit with such a mode as to make the process amount and time less than those of statistical analysis so that the rule making procedure is not limited to the above technique.

The thus determined duration is sent to the duration correction section 1003, to which the user-designated utterance speed level has been inputted, and the phoneme duration is expanded or compressed according to the level. Usually, the utterance speed designation is controlled at five to 10 levels by multiplying the vowel or pause duration by the constant that has been assigned to each level. When a low utterance speed is desired, the phoneme duration is lengthened while, when a high utterance speed is desired, the phoneme duration is shortened.

In FIG. 4, the user-designated sound quality conversion and utterance speed levels are inputted to the sound quality coefficient determination unit 806. These prosodic parameters are used to control the switch 1103 via the selector 1102, where the utterance speed level is determined. When the utterance speed is at the maximum speed level, the terminal (c) is connected to the output of the switch 1103 and, otherwise, the sound quality conversion level is determined by controlling the switch 1103 so that the terminal corresponding to the sound quality level is connected. When the sound quality designation is Level 0, 1, 2, 3, or 4, the terminal (a), (b), (c), (d), or (e) is connected. That is, the respective terminals (a)–(b) are connected to the sound quality conversion coefficient table 1104 to retrieve the corresponding sound quality conversion coefficient data.

The expansion/compression coefficients of voice segments are stored in the sound quality conversion coefficient table 1104. For example, the expansion/compression coefficient Kn corresponding to the sound quality level n is determined as follows.

$$Ko=2.0,\ K1=1.5,\ K2=1.0,\ K3=0.8,\ K4=0.5$$

The voice segment length is multiplied by Kn and the waveform is superimposed to generate a synthetic voice. At Level 2, the coefficient is 1.0 so that no sound quality conversion is made. When the terminal (a) is connected, the coefficient Ko is selected and sent to the sound quality selection section 1101. When the terminal (b) is connected, the coefficient K1 is selected and sent to the sound quality selection section 1101 and so on.

Figure 5:
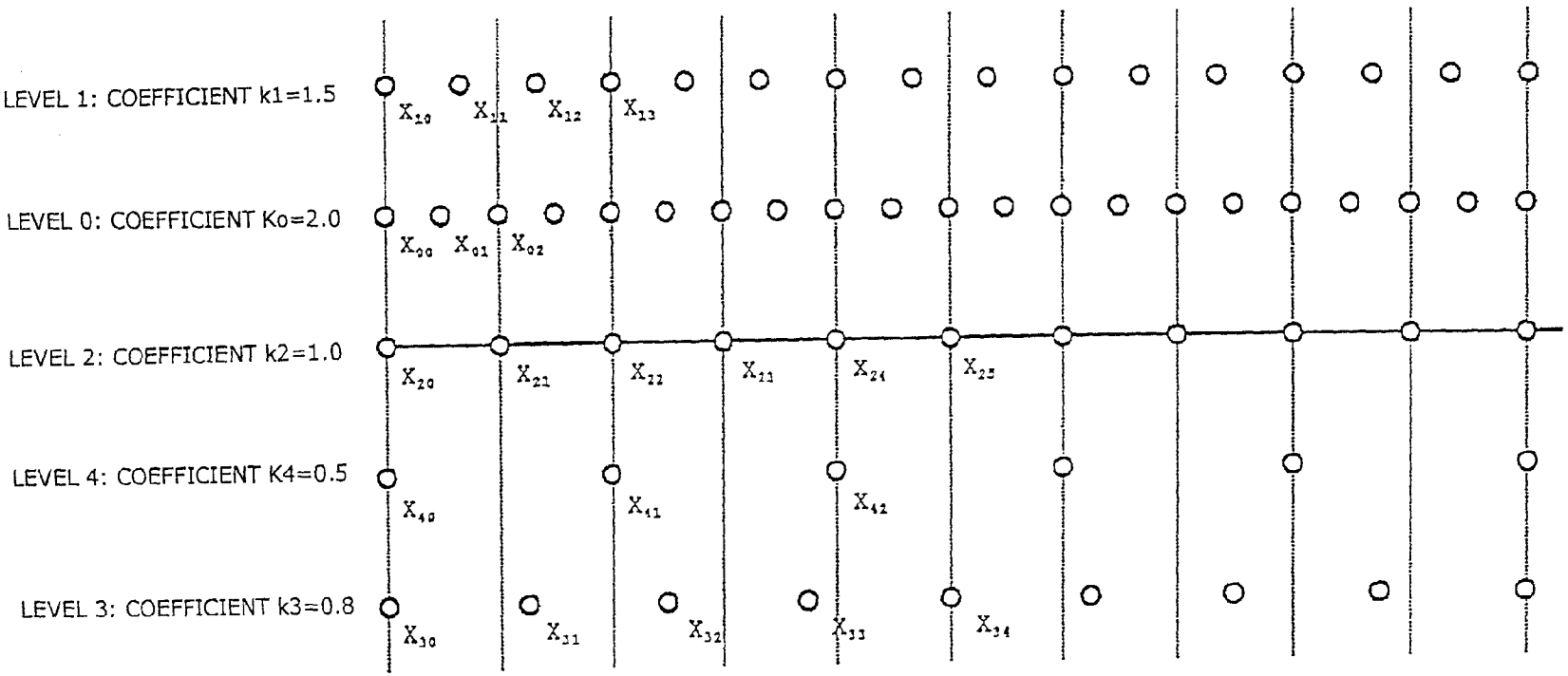
FIG. 5 is a diagram of data re-sampling cycles for the sound quality conversion.

In FIG. 5, if Xnm is defined as the m-th sample of voice segment data at a sound quality conversion level n, the data sequence after sound quality conversion is calculated as follows:

At Level 0, $$X_{00}=X_{20}$$

$$X_{01}=X_{20}\times 1/2+X_{21}\times 1/2$$

$$X_{02}=X_{21}$$

At Level 1, $$X_{10}=X_{20}$$

$$X_{11}=X_{20}\times 1/3+X_{21}\times 2/3$$

$$X_{12}=X_{21}\times 2/3+X_{22}\times 1/3$$

$$X_{13}=X_{22}$$

At Level 3, $$X_{30}=X_{20}$$

$$X_{31}=X_{21}\times 3/4+X_{22}\times 1/4$$

$$X_{32}=X_{22}\times 1/2+X_{23}\times 1/2$$

$$X_{33}=X_{23}\times 1/4+X_{24}\times 3/4$$

$$X_{34}=X_{25}$$

At Level 4, $$X_{40}=X_{20}$$

$$X_{41}=X_{22}$$

wherein X2n is the data sequence before conversion. It should be noted that the foregoing is mere an example for the sound quality conversion. According to the first embodiment of the invention, the sound quality coefficient determination unit has such a function that when the utterance speed is at the maximum speed level, the sound quality conversion designation is made invalid to reduce the process time.

As has been described above, according to the first embodiment of the invention, when the utterance speed is set at the maximum level, the text-to-speech conversion system simplifies or invalidates the function block having a heavy process load so that the sound interruption due to the heavy load is minimized to generate an easy-to-understand synthetic speech.

The prosody properties, such as the pitch and duration, are slightly different from those of the synthetic voice at utterance speeds other than the maximum speed, and the sound quality conversion function is made invalid in this embodiment, but the synthetic speech output at the maximum utterance speed is used generally for "FRF" in which it is important only to understand the contents of a text so that these drawbacks are more tolerable than the sound interruption.

Second Embodiment

This embodiment is different from the convention in that when the utterance speed is set at the maximum level or FRF is turned on, the pitch contour generation process is changed. Accordingly, only the prosody generation module and the pitch contour determination unit that are different from the convention will be described.

Figure 6:
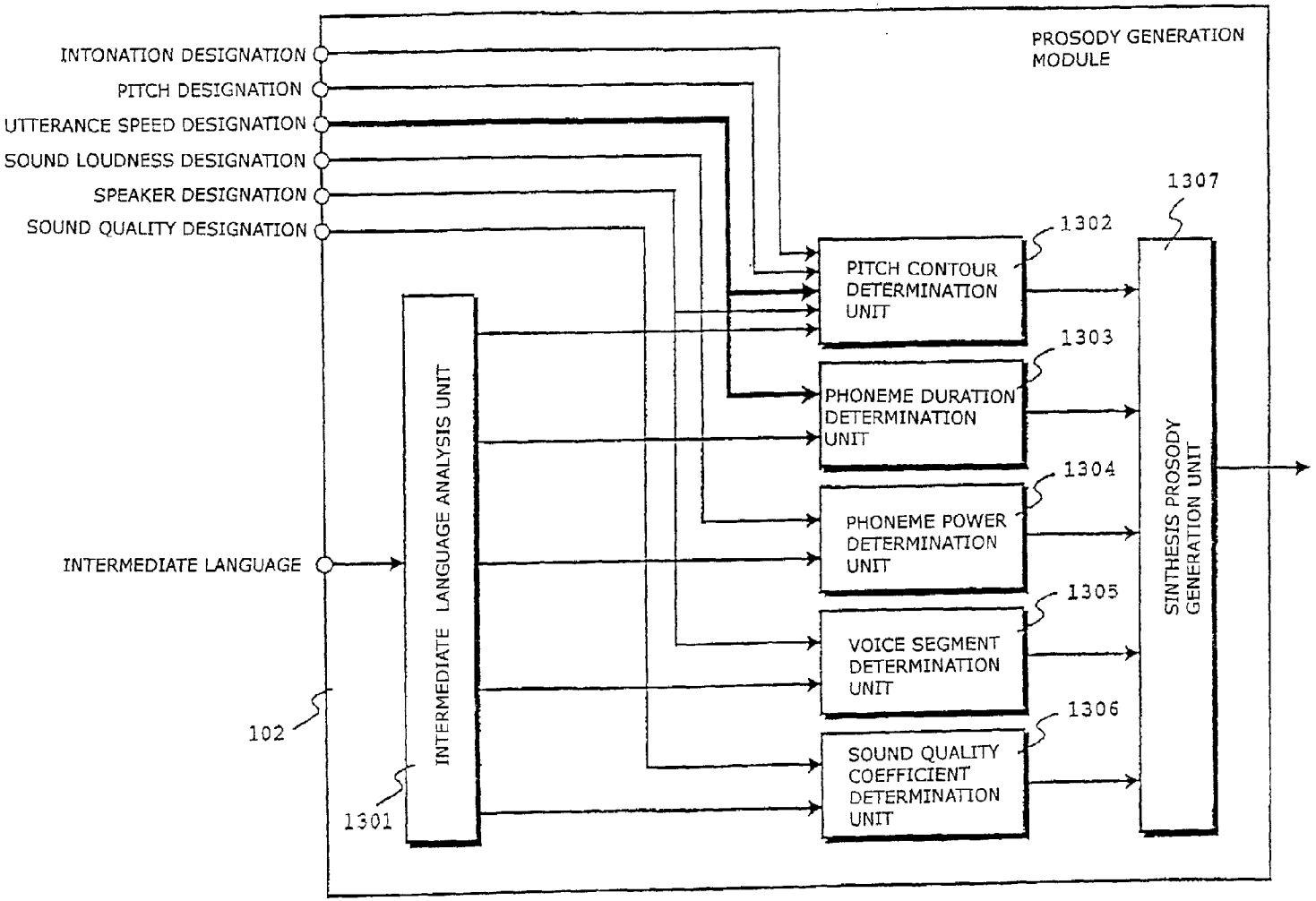
FIG. 6 is a block diagram of a prosody generation module according to the second embodiment of the invention.

In FIG. 6, the prosody generation module 102 receives the intermediate language from the text analysis module 101 and the prosodic parameters designated by the user. An intermediate language analysis unit 1301 receives the intermediate language sentence by sentence and outputs the intermediate language analysis results, such as a phoneme string, phrase information, and accent information, that are required for subsequent prosody generation process to a pitch contour determination unit 1302, a phoneme duration determination unit 1303, a phoneme power determination unit 1304, a voice segment determination unit 1305, and a sound quality coefficient determination unit 1306, respectively.

The pitch contour determination unit 1302 receives the intermediate language analysis results and each of the user-designated intonation, pitch, utterance speed, and speaker parameters and outputs a pitch contour to a synthetic parameter generation unit 1307.

The phoneme duration determination unit 1303 receives the intermediate analysis results and the user-designated utterance speed parameter and outputs data, such as respective phoneme duration and pause lengths, to the synthetic parameter generation unit 1307.

The phoneme power determination unit 1304 receives the intermediate language analysis results and the user-designated intensity parameter and outputs respective phoneme amplitude coefficients to the synthetic parameter generation unit 1307.

The voice segment determination unit 1305 receives the intermediate language analysis results and the user-designated speaker parameter and outputs a phoneme segment address necessary for waveform superimposition to the synthetic parameter generation unit 1307.

The sound quality coefficient determination unit 1306 receives the intermediate language analysis results and the user-designated sound quality and utterance speed parameters and outputs a sound quality conversion coefficient to the synthetic parameter generation unit 1307.

The synthetic parameter generation unit 1307 converts the input prosodic parameters (pitch contour, phoneme duration, pause length, phoneme amplitude coefficient, voice segment address, and sound conversion coefficient) into a waveform generation parameter in a frame of approximately 8 ms and outputs it to the waveform or speech generation module 103.

The prosody generation module 102 is different from the convention in that the utterance speed parameter is inputted to both the phoneme duration determination unit 1303 and the pitch contour determination unit 1302, and in the process inside the pitch contour determination unit 1302. The structures of the text analysis and speech generation modules 101 and 103 are identical with the conventions and, therefore, their description will be omitted. Also, the structure of the prosody generation module 102 is identical with the convention except for the pitch contour determination unit 1302 and, therefore, its description will be omitted.

Figure 7:
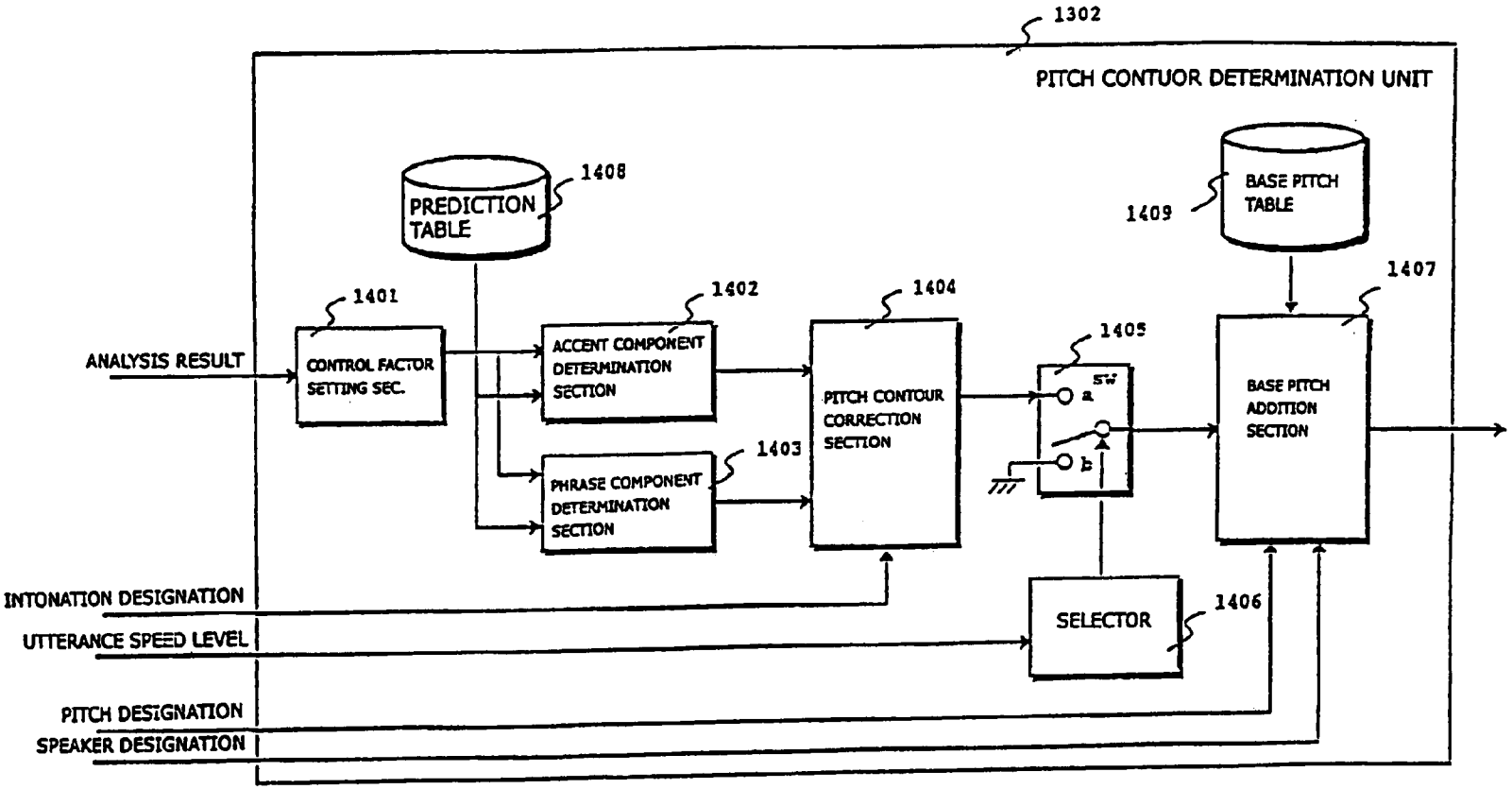
FIG. 7 is a pitch contour determination unit according to the second embodiment of the invention.

In FIG. 7, a control factor setting section 1401 receives the output from the intermediate language analysis unit 1301, and analyzes and outputs a factor parameter for determination of both accent and phrase components to access and phrase component determination sections 1402 and 1403, respectively.

The accent and phrase determination sections 1402 and 1403 are connected to a prediction table 1408 and predict the amplitudes of the respective components by using statistical analysis such as Quantification theory (type one). The predicted accent and phrase component values are inputted to a pitch contour correction section 1404.

The pitch contour correction section 104 receives the intonation level designated by the user, multiplies the accent and phrase components by the constant predetermined according to the level, and outputs the result to the terminal (a) of a switch 1405. The switch 1405 includes a terminal (b), and a selector 1406 outputs a control signal for selecting either the terminal (a) or (b).

The selector 1406 receives the utterance speed level designated by the user and outputs a control signal for selecting the terminal (b) when the utterance speed is at the maximum level and, otherwise, the terminal (a) of the switch 1405. The terminal (b) is grounded so that when the terminal (a) is selected or valid, the switch 1405 outputs the output of the pitch contour correction section 1404 and, when the terminal (b) is valid, it outputs 0 to a base pitch addition section 1407.

The base pitch addition section 1407 receives the pitch level and speaker designated by the user, and data from a base pitch table 1409. The base pitch table 1409 stores constants predetermined according to the pitch level and the sex of the speaker. The base pitch addition section 1407 adds a constant from the table 1409 to the input from the switch 1405 and outputs a pitch contour sequential data to the synthesis parameter generation unit 1307.

In operation, the intermediate language generated by the text analysis module 101 is sent to the intermediate language analysis unit 1301 of the prosody generation module 102. In the intermediate language analysis unit 1301, the data necessary for prosody generation is extracted from the phrase end symbol, word end symbol, accent symbol indicative of the accent nuclear, and phoneme character string and sent to each of the pitch contour, phoneme duration, phoneme power, voice segment, and sound quality coefficient determination units 1302, 1303, 1304, 1305, and 1306, respectively.

In the pitch contour determination unit 1302, the intonation or transition of the pitch is generated and, in the phoneme duration determination unit 1303, the duration of each phoneme and the pause length between phrases or sentences are determined. In the phoneme power determination unit 1304, the phoneme power or transition of the voice waveform amplitude is generated and, in the voice segment determination unit 1305, the address, in the voice segment dictionary 105, of a voice segment necessary for synthetic waveform generation is determined. In the sound quality coefficient determination unit 1306, the parameter for processing the voice segment data by signal process is determined.

Among the various prosody control designations, the intonation and pitch designations are sent to the pitch contour determination unit 1302, the utterance speed designation is sent to the pitch contour determination unit 1302, the intensity designation is sent to the phoneme power determination unit 1304, the speaker designation is sent to the pitch contour and voice segment determination units 1302 and 1305, and the sound quality designation is sent to the sound quality coefficient determination unit 1306.

In FIG. 7, only the process for pitch contour generation is different from the conventional one and, therefore, the description of the other process will be omitted. The analysis results are inputted from the intermediate language analysis module 201 to the control factor setting section 1401, wherein the control factors necessary for predicting the amplitudes of phrase and accent components are set. The data necessary for prediction of the amplitude of a phrase component include the number of malas that constitute the phrase, the relative position in the sentence, and the accent type of the leading word. The data necessary for prediction of the amplitude of an accent component include the accent type of the accent phrase, the number of moras, part of the speech, and relative position in the phrase. These component values are determined by using the prediction table 1408 that has been trained by using statistical analysis, such as Quantification theory (type one), based on the natural utterance data. Quantification theory (type one) is well known and, therefore, its description will be omitted.

The prediction control factors analyzed in the control factor setting section 1401 are sent to the accent and phrase component determination sections 1402 and 1403, respectively, wherein the amplitude of each of the accent and phrase components is predicted by using the prediction table 1408. As in the first embodiment, each component value may be determined by rule. The calculated accent and phrase components are sent to the pitch contour correction section 1404, wherein they are multiplied by the coefficient corresponding to the intonation level designated by the user.

The user-designated intonation is set at three levels, for example, from Level 1 to Level 3, and it is multiplied by 1.5 at Level 1, 1.0 at Level 2, and 0.5 at Level 3.

The corrected accent and phrase components are sent to the terminal (a) of the switch 1405. The terminal (a) or (b) of the switch 1405 is connected responsive to the control signal from the selector 1406. Always, 0 is inputted to the terminal (b).

The user inputs the utterance speed level to the selector 1406 for output control. When the input utterance speed is at the maximum level, the selector 1406 issues a control signal for connecting the terminal (b). Conversely, when the input utterance speed is not at the maximum level, it issues a control signal for connecting the terminal (a). If the utterance speed may vary at five levels from Level 0 to Level 4, wherein the higher the level, the higher the utterance speed, it issues a control signal for connecting the terminal (b) only when the input utterance speed is at Level 4 and, otherwise, a control signal for connecting the terminal (a). That is, when the utterance speed is at the highest level, 0 is selected and, otherwise, the corrected accent and phrase component values from the pitch contour correction section 1404 are selected.

The selected data is sent to the base pitch addition section 1407. The base pitch addition section 1407, into which the pitch designation level is inputted by the user, retrieves the base pitch data corresponding to the level from the base pitch table 1409, adds it to the output value from the switch 1405, and outputs a pitch contour sequential data to the synthesis parameter generation unit 1307.

In the system wherein the pitch can be set at five levels from Level 0 to Level 4, for example, the usual data stored in the base pitch table 1409 are numbers such as 3.0, 3.2, 3.4, 3.6, and 3.8 for the male voice and 4.0, 4.2, 4.4, 4.6, and 4.8 for the female voice.

When the utterance speed designation is at the highest level, the process from the control factor setting section 1401 to the pitch contour correction section 1404 is not necessary.

Figure 8:
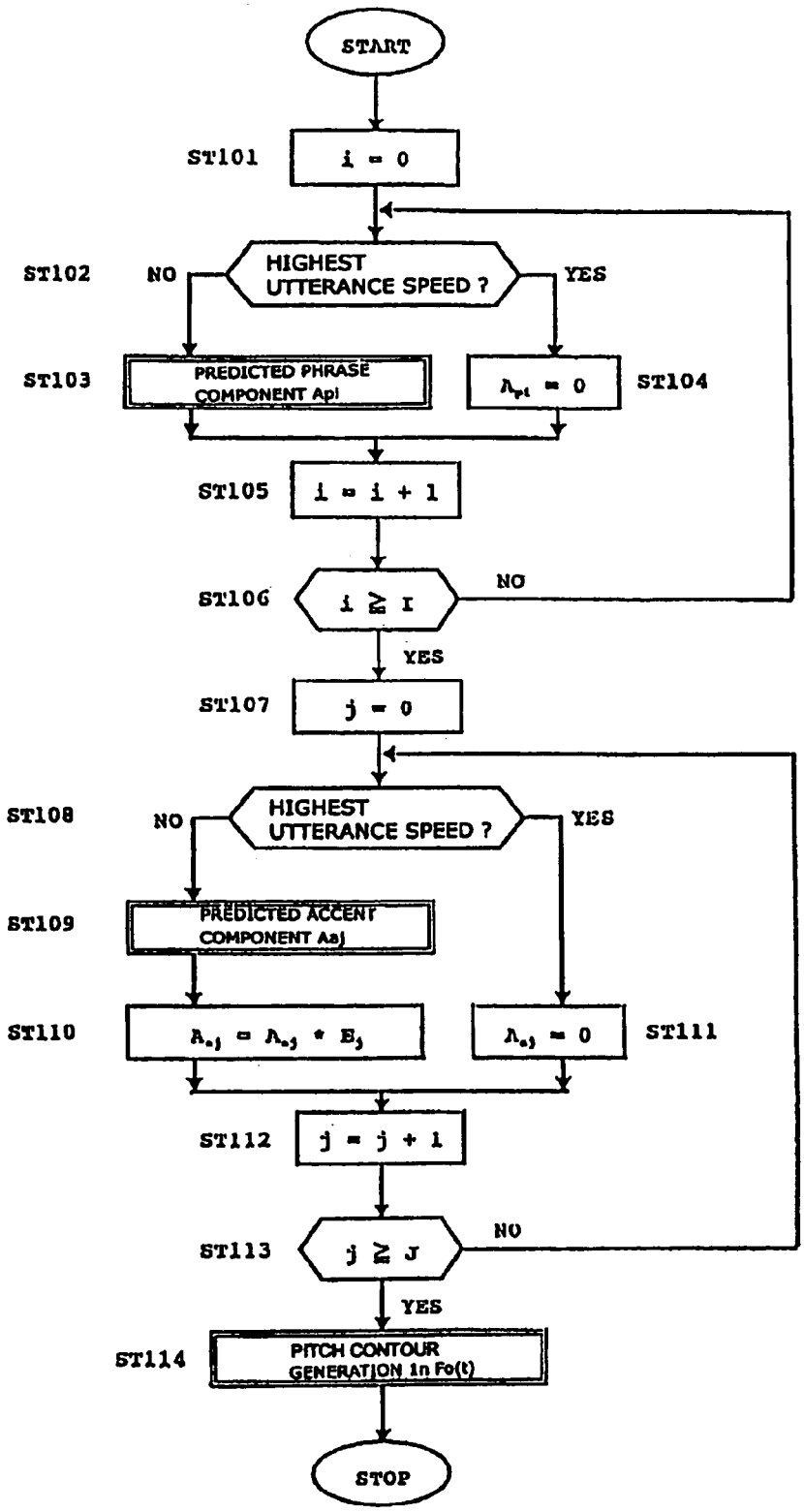
FIG. 8 is a flowchart of the pitch contour generation according to the second embodiment.

In FIG. 8, I is the number of phrases in the input sentence, J is the number of words, Api is the amplitude of an i-th phrase component, Aaj is the amplitude of a j-th accent component, and Ej is the intonation control coefficient designated for the j-th accent phrase.

The amplitude of a phrase component, Api, is calculated from Step ST101 to ST106. In ST101, the phrase counter i is initialized. In ST102, the utterance speed level is determined and, when the utterance speed is at the highest level, the process goes to ST104 and, otherwise, to ST103. In ST104, the amplitude of the i-th phrase, Api, is set at 0 and the process goes to ST105. In ST103, the amplitude of the i-th phrase component, Api, is predicted by using statistical analysis, such as Quantification theory (type one), and the process goes to ST105. In ST105, the phrase counter i is incremented by one. In ST106, it is compared with the number of phrases, I, in the input sentence. When it exceeds the number of phrases, I, or the process for all the phrases is completed, the phrase component generation process is terminated and the process goes to ST107. Otherwise, the process returns to ST102 to repeat the above process for the next phrase.

The amplitude of an accent component, Aaj, is calculated in steps from ST107 to ST113. In ST107, the word counter j is initialized to 0. In ST108, the utterance speed level is determined. When the utterance speed is at the highest level, the process goes to ST111 and, otherwise, goes to ST109. In ST111, the amplitude of the j-th accent component, Aaj, is set at 0 and the process goes to ST112. In ST109, the amplitude of the j-th accent component, Aaj, is predicted by using statistical analysis, such as Quantification theory (type one), and the process goes to ST110. In ST110, the intonation correction to the j-th accent phrase is made by the following equation $$A_{aj}=A_{aj}\times E_j \tag{4}$$

wherein Ej is the intonation control coefficient predetermined corresponding to the intonation control level designated by the user. For example, if it is provided at three levels, wherein the intonation is multiplied by 1.5 at Level 0, 1.0 at Level 1, and 0.5 at Level 3, Ej is given as follows.

Level 0 (Intonation×1.5) Ej=1.5

Level 1 (Intonation×1.0) Ej=1.0

Level 2 (Intonation×0.5) Ej=0.5

After the intonation correction is completed, the process goes to ST112. In ST112, the word counter j is incremented by one. In ST113, it is compared with the number of words, J, in the input sentence. When the word counter j exceeds the number or words, J, or the process for all the words is completed, the accent component generation process is terminated and the process goes to ST114. Otherwise, the process returns to ST108 to repeat the above process for the next accent phrase.

In ST114, a pitch contour is generated from the phrase component amplitude, Api, the accent component amplitude, Aaj, and the base pitch, ln Fmin, which is obtained by referring to the base pitch table 1409, by using Equation (1).

As has been described above, according to the second embodiment of the invention, when the utterance speed is set at the highest level, the intonation component of the pitch contour is made 0 for pitch contour generation so that the intonation does not change at short cycles, thus avoiding the generation of a hard-to-listen synthetic voice.

Figure 9:
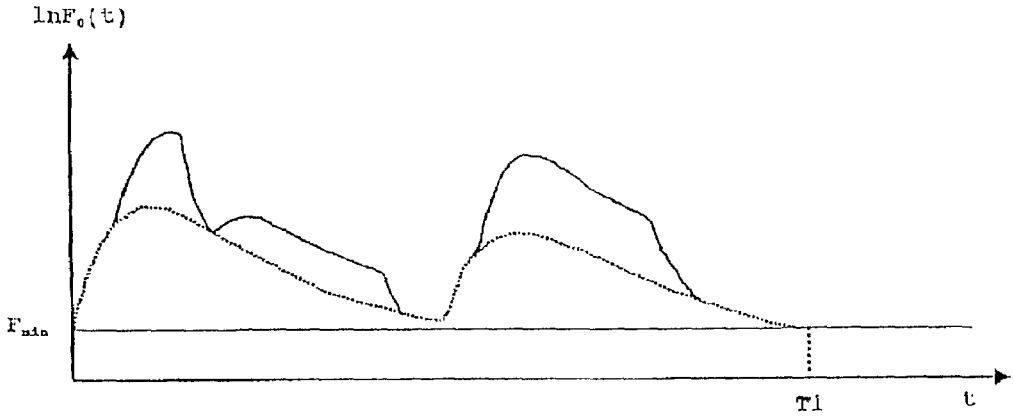
FIG. 9 is a graph of pitch contours at different utterance speeds.
Figure 9:
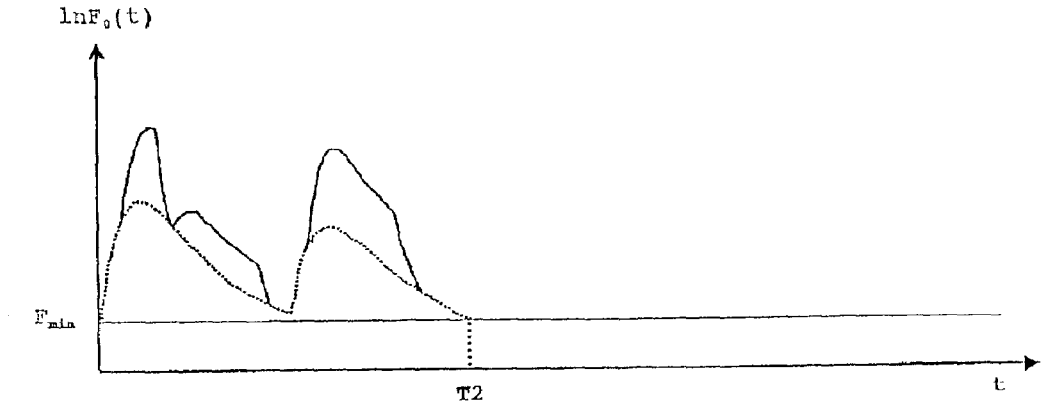

In FIG. 9, Graph (a) shows the pitch contour at the normal utterance speed and Graph (b) shows the pitch contour at the highest utterance speed. The dotted line represents the phrase component and the solid line represents the accent component. If the highest speed is twice the normal speed, the generated waveform is approximately one half of the normal one. T2=T1/2. Since the pitch contour changes faster in proportion to the utterance speed, the intonation of the synthetic voice changes at very short cycles. Actually, however, the phrase or accent phrase boundary can disappear owing to the phrase or accent linkage phenomenon so that the pitch contour (b) is not produced. As the utterance speed becomes higher, the pitch contour changes in a relatively gentle fashion.

In FIG. 9, there are two phrases that can be linked together but, according to the second embodiment of the invention, it is possible to generate an easy-to-listen synthetic speech by making the intonation component 0. By making the intonation 0, the generated voice sounds as a robotics voice having a flat intonation. However, the voice synthesis at the highest speed is used for FRF and, therefore, it is sufficient to grasp the contents of a text and the flat synthetic voice is usable.

Third Embodiment

The third embodiment is different from the conventional one in that a signal sound is inserted between sentences to clarify the boundary between them.

Figure 10:
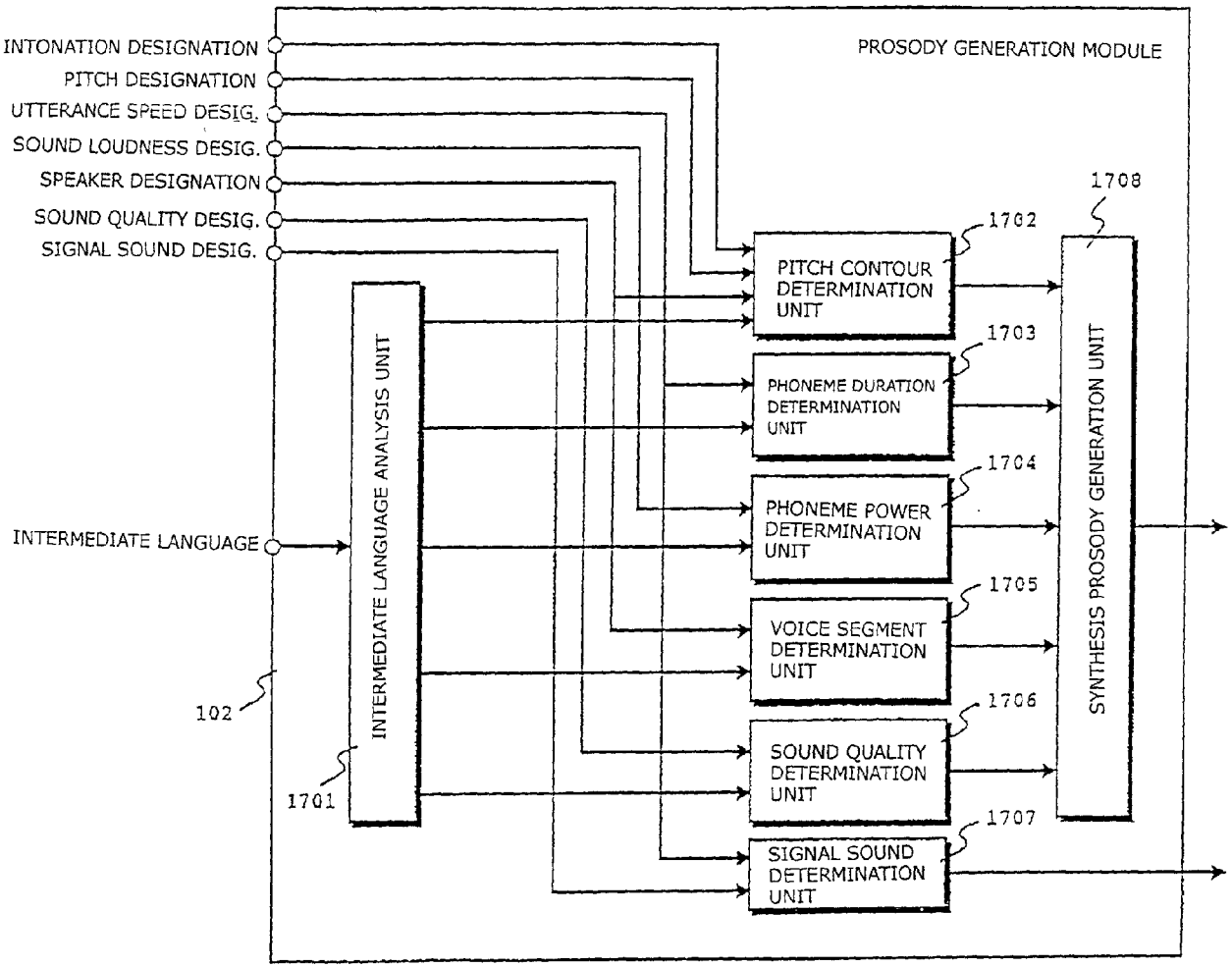
FIG. 10 is a block diagram of a prosody generation module according to the third embodiment of the invention.

In FIG. 10, the prosody generation module 102 receives the intermediate language from the text analysis module 1 and the prosody control parameters designated by the user. The signal sound designation, which designates the kind of a sound inserted between sentences, is a new parameter that is included in neither the conventional one nor the first and second embodiments.

The intermediate language analysis unit 1701 receives the intermediate language sentence by sentence and outputs the intermediate language analysis results, such as the phoneme string, phrase information, and accent information, necessary for subsequent prosody generation process to each of pitch contour, phoneme duration, phoneme power, voice segment, and sound quality coefficient determination units 1702, 1703, 1704, 1705, and 1706.

The pitch contour determination unit 1702 receives the intermediate language analysis results and each of the intonation, pitch, utterance speed, and speaker parameters designated by the user and outputs a pitch contour to a synthesis parameter generation unit 1708.

The phoneme duration determination unit 1703 receives the intermediate language analysis results and the utterance speed parameter designated by the user and outputs data, such as the phoneme duration and pause length, to the synthesis parameter generation unit 1708.

The phoneme power determination unit 1704 receives the intermediate language analysis results and the sound intensity designated by the user and outputs respective phoneme amplitude coefficients to the synthesis parameter generation unit 1708.

The voice segment determination unit 1705 receives the intermediate language analysis results and the speaker parameter designated by the user and outputs the voice segment address necessary for waveform superimposition to the synthesis parameter generation unit 1708.

The sound quality coefficient determination unit 1706 receives the intermediate language analysis results and the sound quality parameter designated by the user and outputs a sound quality conversion parameter to the synthesis parameter generation unit 1708.

The signal sound determination unit 1707 receives the utterance speed and signal sound parameters designated by the user and outputs a signal sound control signal for the kind and control of a signal sound to the speech generation module 103.

The synthesis parameter generation unit 1708 converts the input prosody parameters (pitch contour, phoneme duration, pause length, phoneme amplitude coefficient, voice segment address, and sound quality conversion coefficient) into a waveform (speech) generation parameter in the frame of about 8 ms and outputs it to the speech generation module 103.

The prosody generation module 102 is different from the conventional one in that the signal sound determination unit 1707 is provided and that the signal sound parameter is designated by the user, and in the inside structure of the speech generation module 103. The text analysis module 101 is identical with the conventional one and, therefore, the description of its structure will be omitted.

Figure 11:
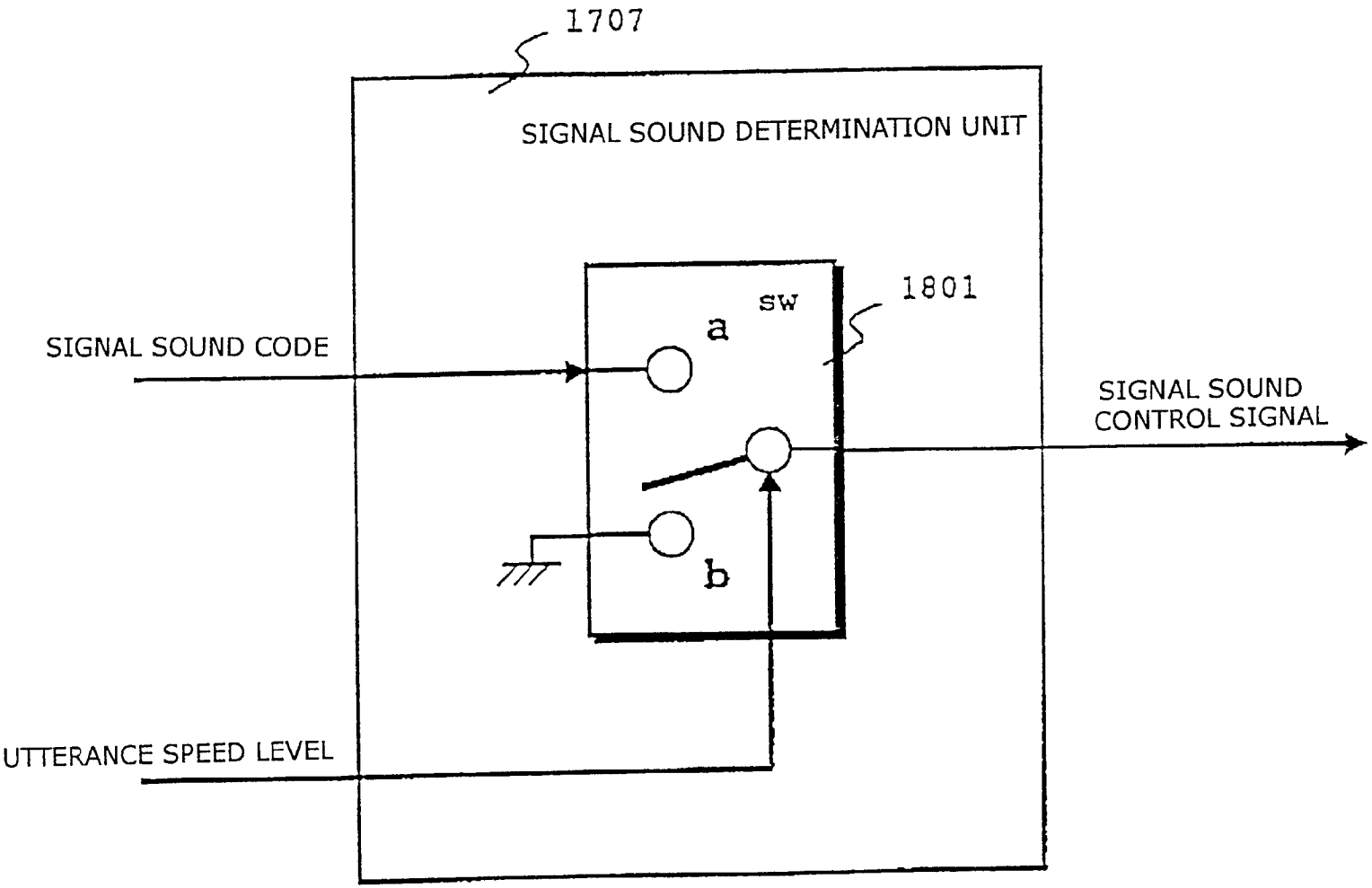
FIG. 11 is a block diagram of a signal sound determination unit according to the third embodiment.

In FIG. 11, the signal sound determination unit 1707 is merely a switch. The utterance speed level designated by the user is connected to the terminal (a) of a switch 1801 while the terminal (b) always is grounded. The switch 1801 is made such that either of the terminals (a) and (b) is selected according to the utterance speed level. That is, when the utterance speed is at the highest level, the terminal (a) is selected and, otherwise, the terminal (b) is selected. Consequently, when the utterance speed is at the highest level, the signal sound code is outputted and, otherwise, 0 is outputted. The signal sound control signal from the switch 1801 is inputted to the speech generation module 103.

Figure 12:
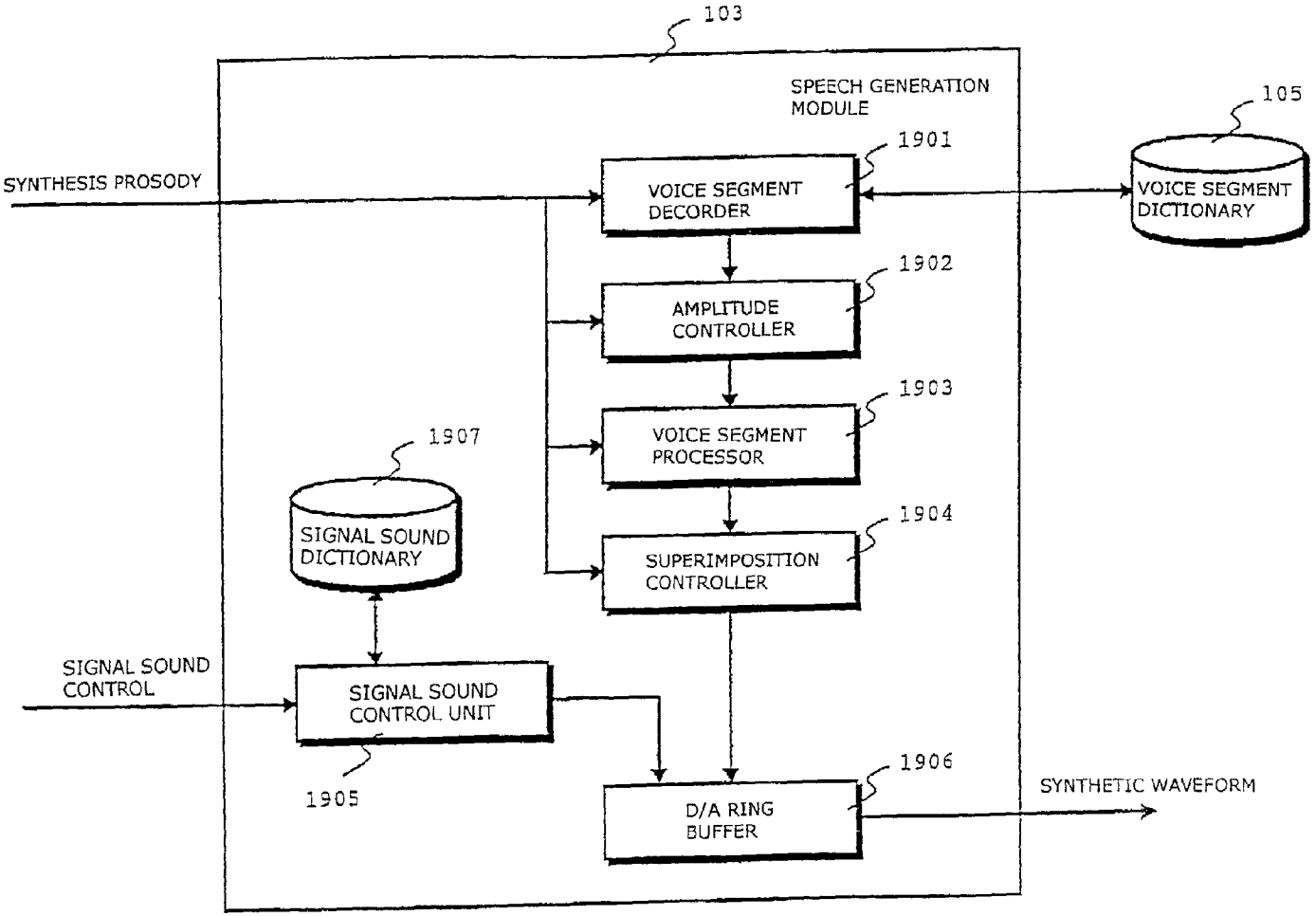
FIG. 12 is a block diagram of a speech generation module according to the third embodiment.

In FIG. 12, the speech generation module 103 according to the third embodiment comprises a voice segment decoding unit 1901, an amplitude control unit 1902, a voice segment processing unit 1903, a superimposition control unit 1904, a signal sound control unit 1905, a D/A ring buffer 1906, and a signal sound dictionary 1907.

The prosody generation module 102 outputs a synthesis parameter to the voice segment decoding unit 1901. The voice segment decoding unit 1901, to which the voice segment dictionary 105 is connected, loads voice segment data from the dictionary 105 with the voice segment address as a reference pointer, performs a decoding process, if necessary, and outputs the decoded voice segment data to the amplitude control unit 1902. The voice segment dictionary 105 stores voice segment data for voice synthesis. Where some kind of compression has been applied for saving the storage capacity, the decoding process is effected and, otherwise, mere reading is made.

The amplitude control unit 1902 receives the decoded voice segment data and the synthesis parameter and controls the power of the voice segment data with the phoneme amplitude coefficient of the synthesis parameter, and outputs it to the voice segment process unit 1903.

The voice segment process unit 1903 receives the amplitude-controlled voice segment data and the synthesis parameter and performs an expansion/compression process of the voice segment data with the sound quality conversion coefficient of the synthesis parameter, and outputs it to the superimposition control unit 1904.

The superimposition control unit 1904 receives the expansion/compression-processed voice date and the synthesis parameter, performs waveform superimposition of the voice segment data with the pitch contour, phoneme duration, and pause length parameters of the synthesis parameter, and outputs the generated waveform sequentially to the D/A ring buffer 1906 for writing. The D/A ring buffer 1906 sends the written data to a D/A converter (not shown) at an output sampling cycle set in the text-to-speech conversion system for outputting a synthetic voice from a speaker.

The signal sound control unit 1905 of the speech generation module 103 receives the signal sound control signal from the prosody generation module 102. It is connected to the signal sound dictionary 1907 so that it processes the stored data as need arises and outputs it to the D/A ring buffer 1906. The writing is made after the superimposition control unit 1904 has outputted a sentence of synthetic waveform (speech) or before the synthetic waveform (speech) is written.

The signal sound dictionary 1907 may store either pulse code modulation (PCM) or standard sine wave data of various kinds of effective sound. In the case of PCM data, the signal sound control unit 1905 reads data from the signal sound dictionary 1907 and outputs it as it is to the D/A ring buffer 1906. In the case of sine wave data, it reads data from the signal sound dictionary 1907 and connects it repeatedly for output. Where the signal sound control signal is 0, no process is made for output to the D/A ring buffer 1906.

In operation, only the differences from the convention are the pitch contour and waveform (speech) generation processes and, therefore, the description of the other processes will be omitted.

The intermediate language generated in the text analysis module 101 is sent to the intermediate language analysis unit 1701 of the prosodic parameter generation module 102. In the intermediate language analysis unit 1701, the data necessary for prosody generation is extracted from the phrase end code, word end code, accent code indicative of the accent nuclear, and phoneme code string and sends it to the pitch contour, phoneme duration, phoneme power, voice segment, and sound quality coefficient determination units 1702, 1703, 1704, 1705, and 1706, respectively.

In the pitch contour determination unit 1702, the intonation indicative of transition of the pitch is generated and, in the phoneme duration determination unit 1703, the duration of each phoneme and the pause length inserted in phrases or sentences are determined. In the phoneme power determination unit 1704, the phoneme power indicative of changes in the amplitude of a voice waveform is generated and, in the voice segment termination unit 1705, the address, in the voice segment dictionary 105, of a phoneme segment necessary for synthetic waveform generation. In the sound quality coefficient determination unit 1706, the parameter for processing signals of the voice segment data is determined. Of the prosody control designations, the intonation and pitch designations are sent to the pitch contour determination unit 1702, the utterance speed designation is sent to the phoneme duration and signal sound determination units 1703 and 1707, respectively, the intensity designation is sent to the phoneme power determination unit 1704, the speaker designation is sent to the pitch contour and voice segment determination units 1702 and 705, respectively, the sound quality designation is sent to the sound quality coefficient determination unit 1706, and the signal sound designation is sent to the signal sound determination unit 1707.

The pitch contour, phoneme duration, phoneme power, voice segment, and sound quality coefficient determination units 1702, 1703, 1704, 1705, and 1706 are identical with the convention and, therefore, their description will be omitted.

The prosody generation module 102 according to the third embodiment is different from the convention in that the signal sound determination unit 1707 is added so that its operation will be described with reference to FIG. 11. The signal sound determination unit 1707 comprises a switch 1801 that is made such that it is controlled by the utterance speed designated by the user to connect either terminal (a) or (b). When the utterance speed level is at the highest speed, the terminal (a) is connected and, otherwise, the terminal (b) is connected to the output. The signal sound code designated by the user is inputted to the terminal (a) while the ground level or 0 is inputted to the terminal (b). That is, the switch 1801 outputs the signal sound code at the highest utterance speed and 0 at the other utterance speeds. The signal sound control signal outputted from the switch 1801 is sent to the waveform (speech) generation module 103.

In FIG. 12, the synthesis parameter generated in the synthesis parameter generation unit 1708 of the prosody generation module 102 is sent to the voice segment decoder, amplitude control, voice segment process, and superimposition control units 1901, 1902, 1903, and 1904, respectively, of the speech generation module 103.

In the voice segment decoder unit 1901, the voice segment data is loaded from the voice segment dictionary 105 with the voice address as a reference pointer, decoded, if necessary, and sends the decoded voice segment data to the amplitude control unit 1902. The voice segments, a source of speech synthesis, stored in the voice segment dictionary 105 are superimposed at the cycle specified by the pitch contour to generate a voice waveform.

The voice segments herein used mean units of voice that are connected to generate a synthetic waveform (speech) and vary with the kind of sound. Generally, they are composed of a phoneme string such as CV, VV, VCV, and CVC, wherein C and V represent consonant and vowel, respectively. The voice segments of the same phoneme can be composed of various units according to adjacent phoneme environments so that the data capacity becomes huge. For this reason, it is frequent to apply a compression technique such as adaptive differential PCM or composition by pairing a frequency parameter and a driving sound source data. In some cases, it is composed as PCM data without compression. The voice segment data decoded in the voice segment decoder unit 1901 is sent to the amplitude control unit 1902 for power control.

In the amplitude control unit 1902, the voice segment data is multiplied by the amplitude coefficient for making amplitude control. The amplitude coefficient is determined empirically from information such as the intensity level designated by the user, the kind of a phoneme, the position of a phoneme in the breath group, and the position in the phoneme (rising, stationary, and falling sections). The amplitude-controlled voice segment is sent to the voice segment process unit 1903.

In the voice segment process unit 1903, the expansion/compression (re-sampling) of the voice segment is effected according to the sound quality conversion level designated by the user. The sound quality conversion is a function of processing signals of the voice segments registered in the voice segment dictionary 105 so that the voice segments sound as those of other speakers. Generally, it is achieved by linearly expanding or compressing the voice segment data. The expansion is made by over-sampling the voice segment data, providing deep voice. Conversely, the compression is made by down-sampling the voice segment data, providing thin voice. This is a function for providing other speakers with the same data and is not limited to the above techniques. Where there is no sound quality conversion designated by the user, no process is made in the voice segment process unit 1903.

The generated voice segments undergo waveform superimposition in the superimposition control unit 1904. The common technique is to superimpose the voice segment data while shifting them with the pitch cycle specified by the pitch contour.

The thus generated synthetic waveform is written sequentially in the D/A ring buffer 1906 and sent to a D/A converter (not shown) with the output sampling cycle set in the text-to-speech conversion system for outputting a synthetic voice or speech from a speaker.

The signal sound control signal is inputted to the speech generation module 103 from the signal sound determination unit 1707. It is a signal for writing in the D/A ring buffer 1906 the data registered in the signal sound dictionary 1907 via the signal sound control unit 1905. When the signal sound control signal is 0 or the user-designated utterance speed is not at the highest speed level, no process is made in the signal sound control unit 1905. When the user-designated utterance speed is at the highest speed level, the signal sound control signal is considered as a kind of signal sound to load data from the signal sound dictionary 1907.

Suppose that there are three kinds of signal sound; that is, one cycle of each of sine wave data at 500 Hz, 1 k Hz, and 2 k Hz is stored in the signal sound dictionary 1907 and that a synthetic sound "pit" is generated by connecting them repeatedly for a plurality of times. The signal sound control signal can take four values; i.e., 0, 1, 2, and 3. At 0, no process is effected and, at 1, the sine wave data of 500 Hz is read from the signal sound dictionary 1907, connected for a predetermined times, and written in the D/A ring buffer 1906. At 2, the sine wave data of 2 k Hz is read from the signal sound dictionary 1907, connected for a predetermined times, and written in the D/A ring buffer 1906. The writing is made after the superimposition control unit 1904 has outputted a sentence of synthetic waveform (speech) or before the synthetic waveform is written. Consequently, the signal sound is outputted between sentences. The appropriate cycles of the output sine wave data range between 100 and 200 ms.

The signal sounds to be outputted may be stored as PCM data in the signal sound dictionary 1907. In this case, the data read from the signal sound dictionary 1907 is output as it is to the D/A ring buffer 1906.

As been described above, according to the third embodiment, when the utterance speed is set at the highest level, the function for inserting a signal sound between sentences resolves the problem that the boundaries between sentences are so vague that the contents of the read text are difficult to understand.

Suppose that the following sentences are synthesized into a text.

"Planned Attendants: Development Division Chief Yamada. Planning Division Chief Saito. Sales Division No. 1 Chief Watanabe."

If the process unit or distinction between sentences is made by the period ".", the above composition is composed of the following three sentences.

(1) "Planned attendants: Development Division Chief Yamada."

(2) "Planning Division Chief Saito."

(3) "Sales Division No. 1 Chief Watanabe."

According to the convention, as the utterance speed becomes higher, the pause length at the end of a sentence becomes smaller so that the synthetic voice of "Yamada" at the tail of the sentence (1) and the synthetic voice "Planning Division" at the head of the sentence (2) are outputted almost continuously so that such misunderstanding as "Yamada"="Planning Division" can take place.

According to the third embodiment, however, the signal sound, such as "pit", is inserted between the synthetic voices "Yamada" and "Planning Division" so that such misunderstanding is avoided.

Fourth Embodiment

Figure 13:
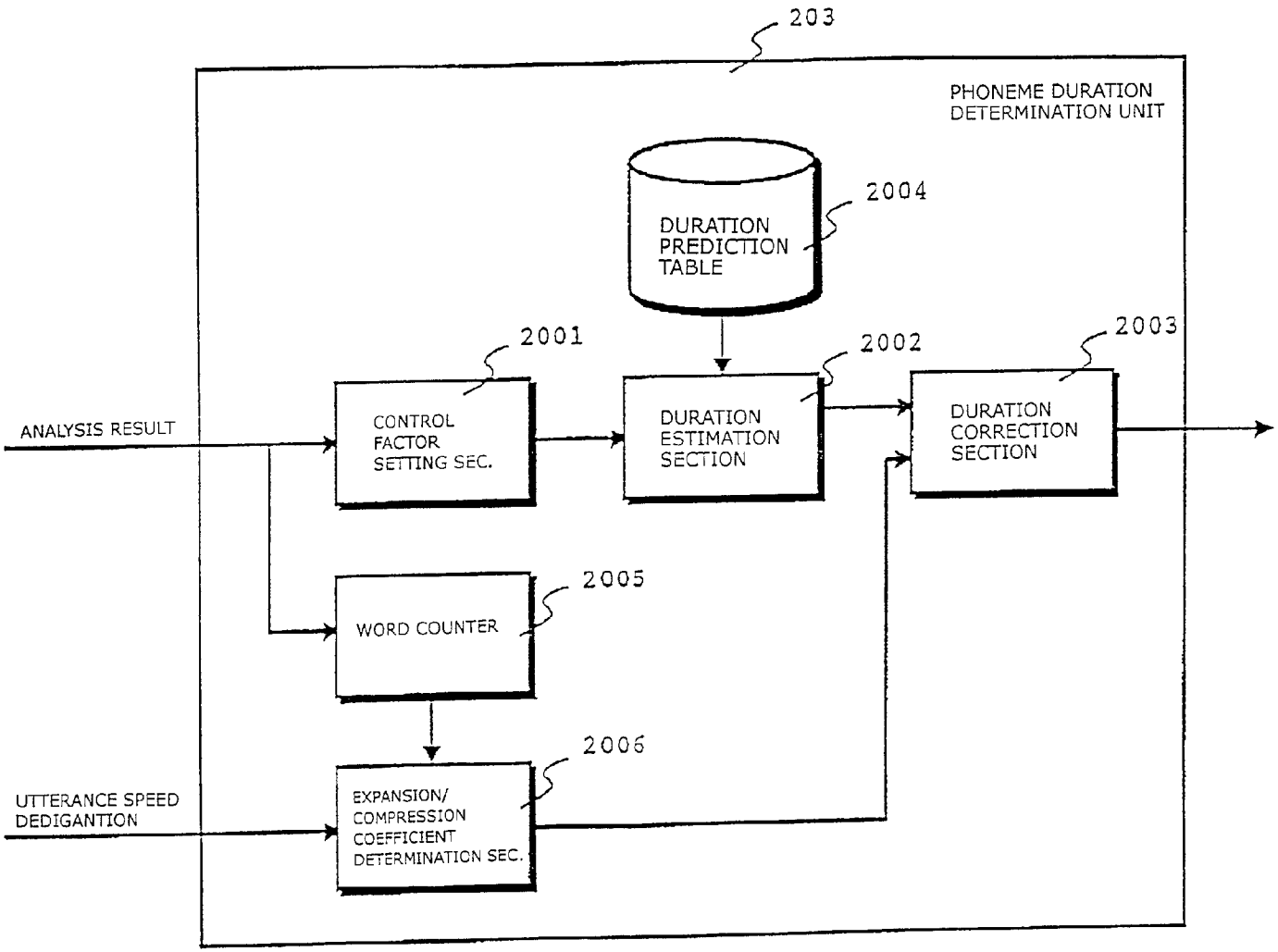
FIG. 13 is a block diagram of a phoneme duration determination unit according to the fourth embodiment.

In FIG. 13, the fourth embodiment is different from the convention in that, it determines whether the text under process is the leading word or phrase in the sentence to determine the expansion/compression rate of the phoneme duration for FRF. Accordingly, the description will be made centered on the phoneme duration determination unit.

The phoneme duration determination unit 203 receives the analysis results containing the phoneme and prosody information from the intermediate language analysis unit 201 and the utterance speed level designated by the user. The intermediate language analysis results of a sentence are outputted to a control factor setting unit 2001 and a word counter 2005. The control factor setting unit 2001 analyzes the control factor parameter necessary for phoneme duration determination and outputs the result to a duration estimation unit 2002. The duration is determined by statistical analysis, such as Quantification theory (type one). Usually, the phoneme duration estimation is based on the kinds of phonemes adjacent the target phoneme or the syllable position in the word and breath group. The pause length is estimated from the information such as the number of moras in adjacent phrases. The control factor setting unit 2001 extracts the information necessary for these predictions.

The duration estimation unit 2002 is connected to a duration prediction table 2004 for making duration predication and outputs it to a duration correction unit 2003. The duration prediction table 2004 contains the data that has been trained by using statistical analysis, such as Quantification theory (type one), based on a large amount of natural utterance data.

The word counter 2005 determines whether the phoneme under analysis is contained in the leading word or phrase in the sentence and outputs the result to an expansion/compression coefficient determination unit 2006.

The expansion/compression coefficient determination unit 2006 also receives the utterance speed level designated by the user and determines the correction coefficient of a phoneme duration for the phoneme under process and outputs it to the duration correction unit 2003.

The duration correction unit 2003 multiplies the phoneme duration predicted in the duration estimation unit 2002 by the expansion/compression coefficient determined in the expansion/compression coefficient determination unit 2006 for making phoneme correction and outputs it to the synthesis parameter (prosody) generation module.

In operation, the phoneme duration determination process will be described with reference to FIGS. 13 and 14.

The analysis results of a sentence are inputted from the intermediate language analysis unit 201 to the control factor setting unit 2001 and the word counter 2005, respectively. In the control factor setting unit 2001, the control factors necessary for determining the phoneme duration (consonant, vowel, and closed section) and the pause length. The data necessary for phoneme duration determination includes the kind of the target phoneme, kinds of phonemes adjacent the target syllable, or the syllable position in the word or breath group. The data necessary for pause length determination is information such as the number of moras in adjacent phrases. The determination of these durations employs the duration prediction table 2004.

The duration prediction table 2004 is a table that has been trained based on the natural utterance data by statistical analysis such as Quantification theory (type one). The duration estimation unit 2002 looks up this table to predict the phoneme duration and pause length. The respective phoneme duration lengths calculated in the duration estimation unit 2002 are for the normal utterance speed. They have been are corrected in the duration correction unit 2003 according to the utterance speed designated by the user. Usually, the utterance speed designation is controlled at five to 10 steps by multiplication of a constant predetermined for each level. Where a low utterance speed is desired, the phoneme duration is lengthened while, where a high utterance speed is desired, the phoneme duration is shortened.

Also, the word counter 2005, into which the analysis results of a sentence has been inputted from the intermediate language analysis unit 201, determines whether the phoneme under analysis is contained in the leading word or phrase in the sentence. The result outputted from the word counter 2005 is either TRUE where the phoneme is contained in the leading word or FALSE in the other case. The result from the word counter 2005 is sent to the expansion/compression coefficient determination unit 2006.

The result from the word counter 2005 and the utterance speed level designated by the user is inputted to the expansion/compression coefficient determination unit 2006 to calculate the expansion/compression coefficient of the phoneme. If the utterance speed is controlled at five steps: Levels 0, 1, 2, 3, and 4, and the constant Tn for each level n is defined as follows.

$$To=2.0,\ T1=1.5,\ T2=1.0,\ T3\ 0.75,\ \text{and}\ T4=0.5.$$

The normal utterance speed is set at Level 2, and the utterance speed for FRF is set at Level 4. When the signal from the word counter 2005 is TRUE, Tn is outputted Lo the duration correction unit 2003 as it is if the utterance speed is at Level 0 to 3. If the utterance speed is at Level 4, the normal utterance value, T2, is outputted. If the signal from the word counter 2005 is FALSE, Tn is outputted to the duration correction unit 2003 as it is regardless of the utterance speed level.

In the duration correction unit 2003, the phoneme duration from the duration estimation unit 2002 is multiplied by the expansion/compression coefficient from the expansion/compression coefficient determination unit 2006. Usually, only the vowel length is corrected. The phoneme duration corrected according to the utterance speed level is sent to the synthesis parameter generation unit.

Figure 14:
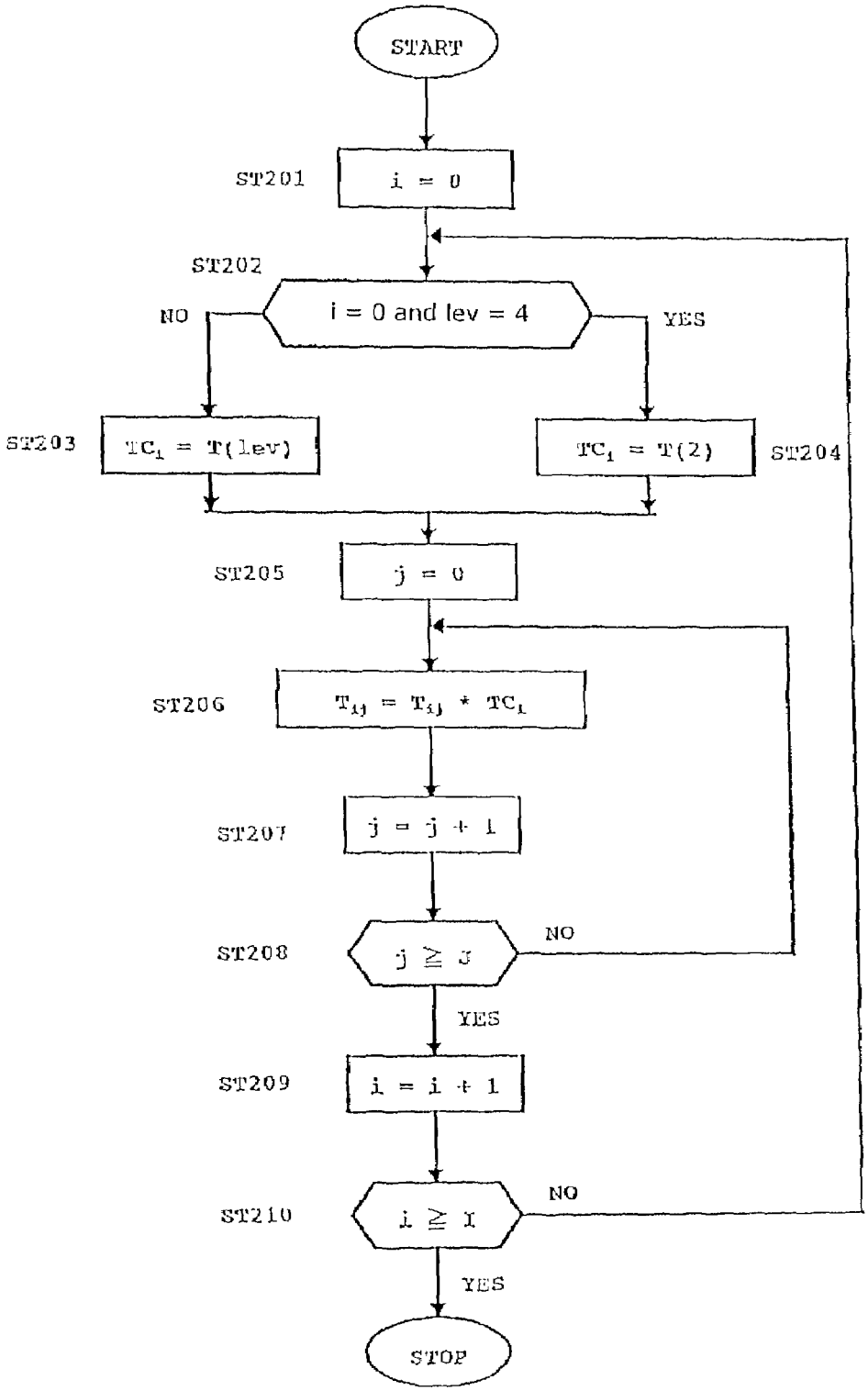
FIG. 14 is a flowchart of the phoneme duration determination according to the fourth embodiment.
Figure 15:
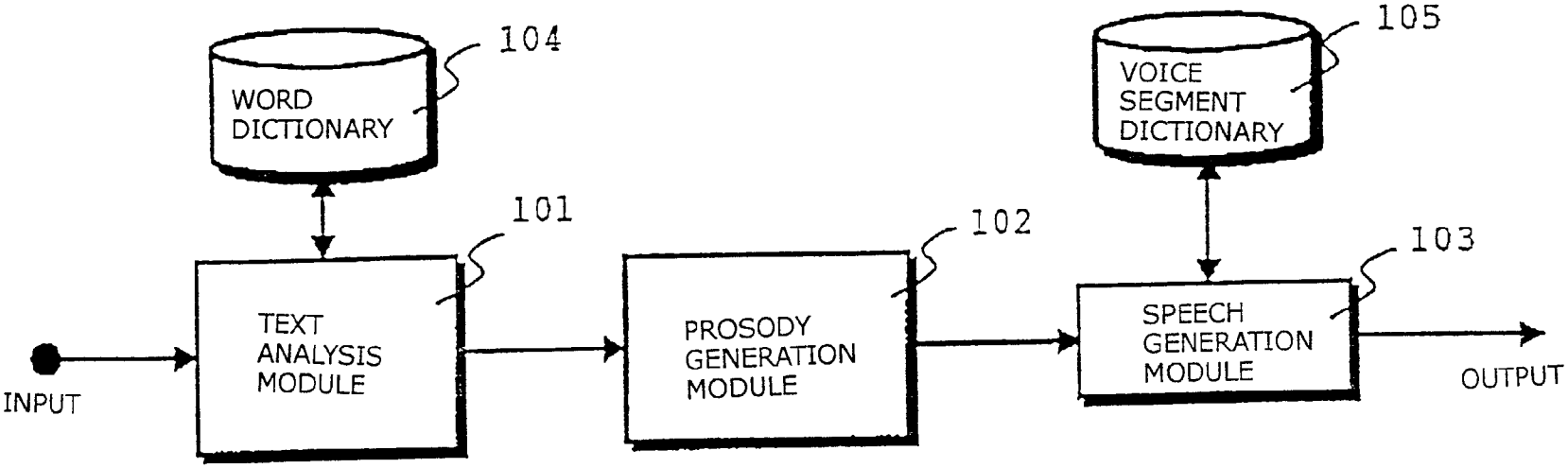
FIG. 15 PRIOR ART
FIG. 15 is a block diagram of a common text-to-speech conversion system.
Figure 16:
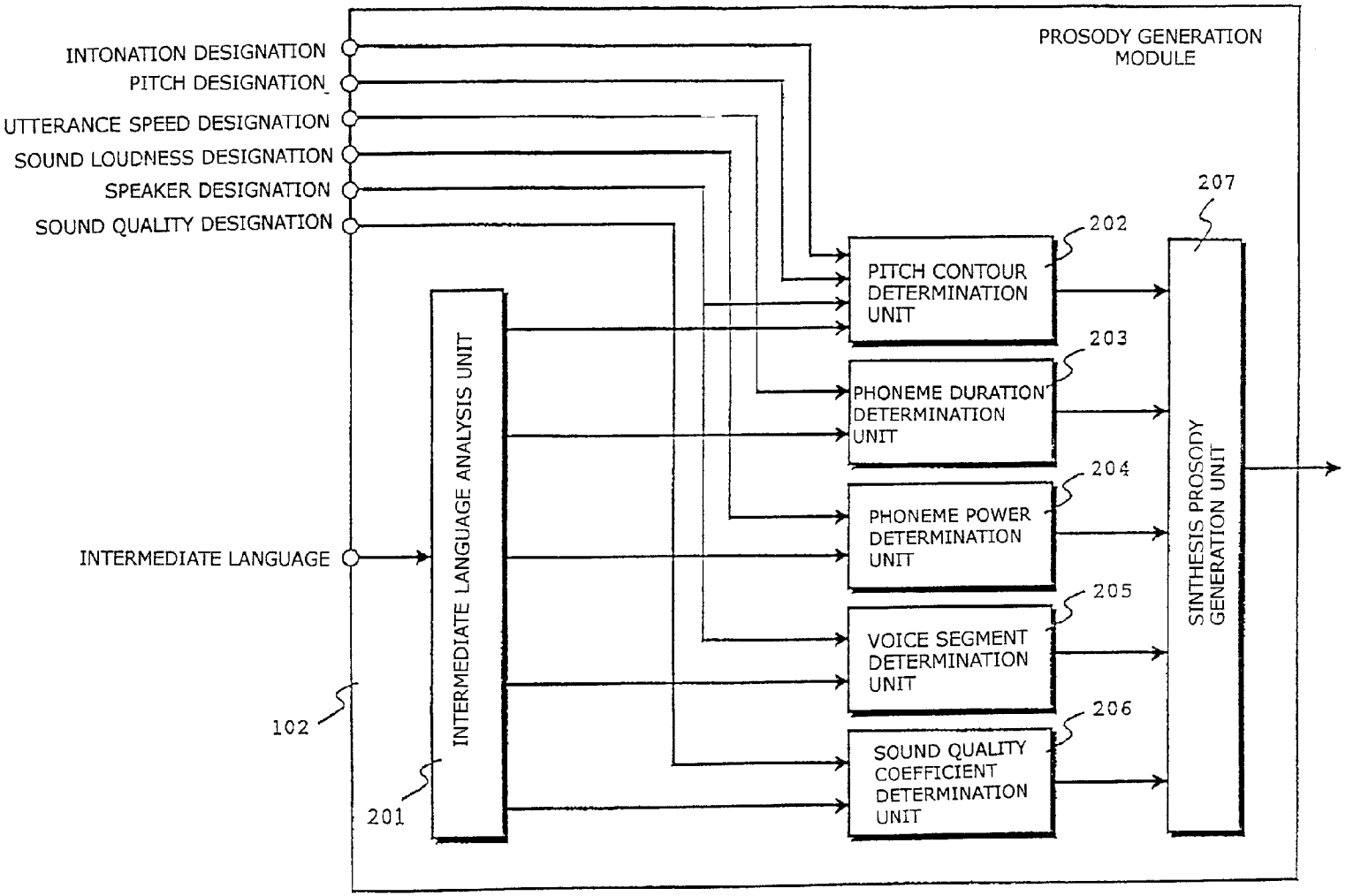
FIG. 16 PRIOR ART
FIG. 16 is a block diagram of a conventional prosody generation module.
Figure 17:
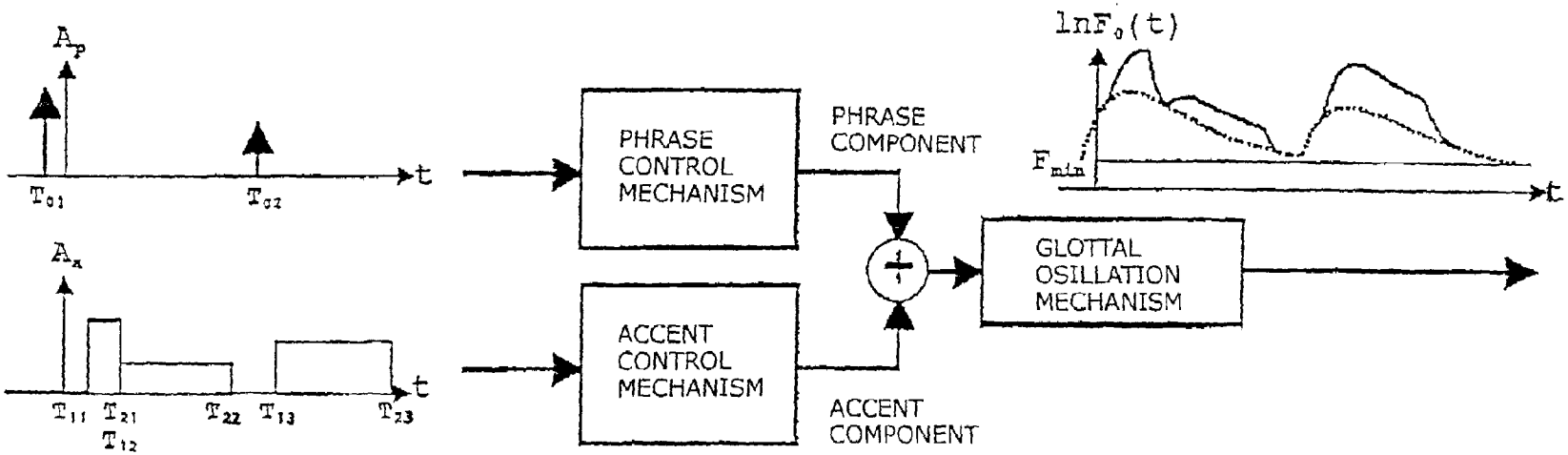
FIG. 17 is a diagram of a pitch contour generation model.
Figure 18:
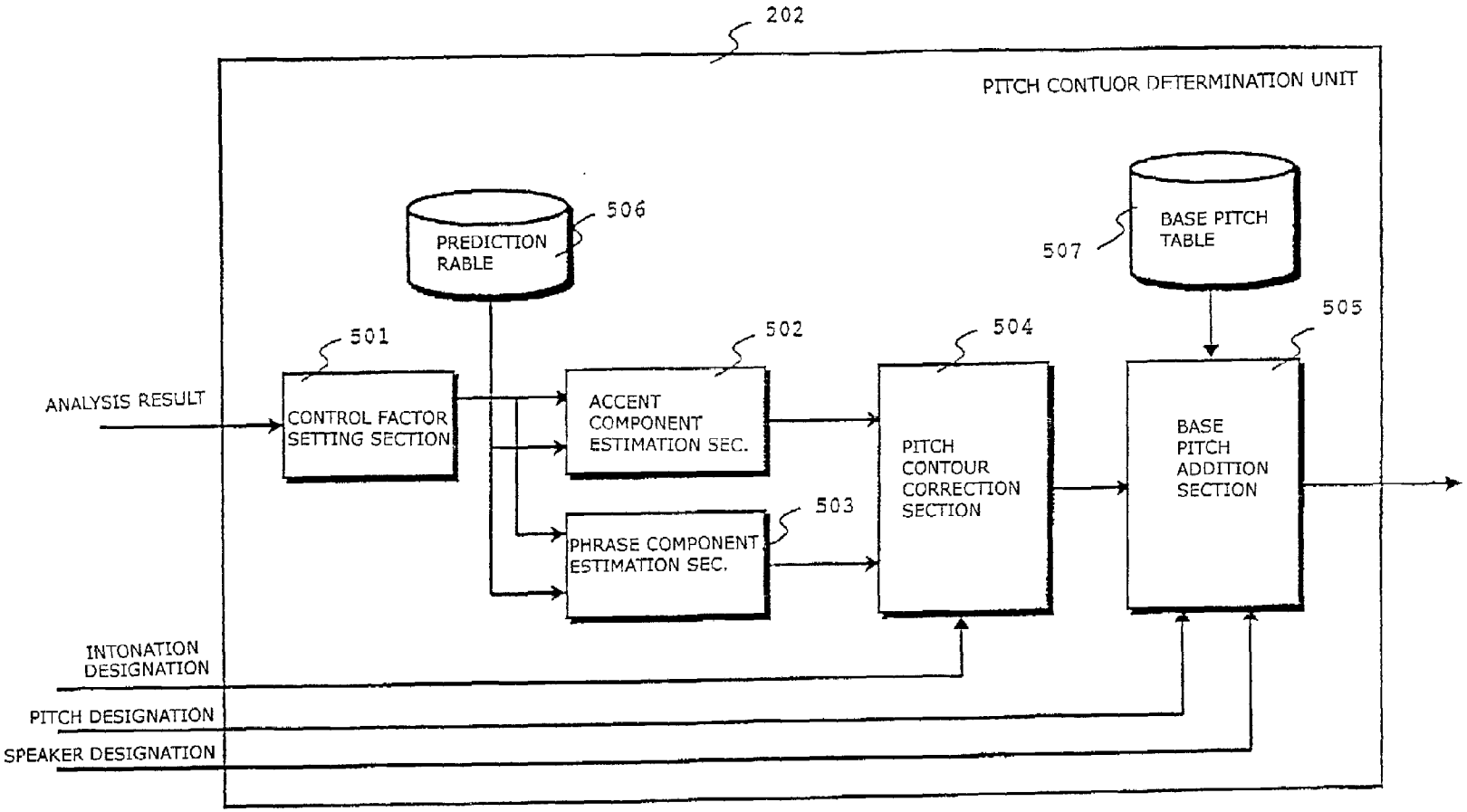
FIG. 18 PRIOR ART
FIG. 18 is a block diagram of a conventional pitch contour determination unit.
Figure 19:
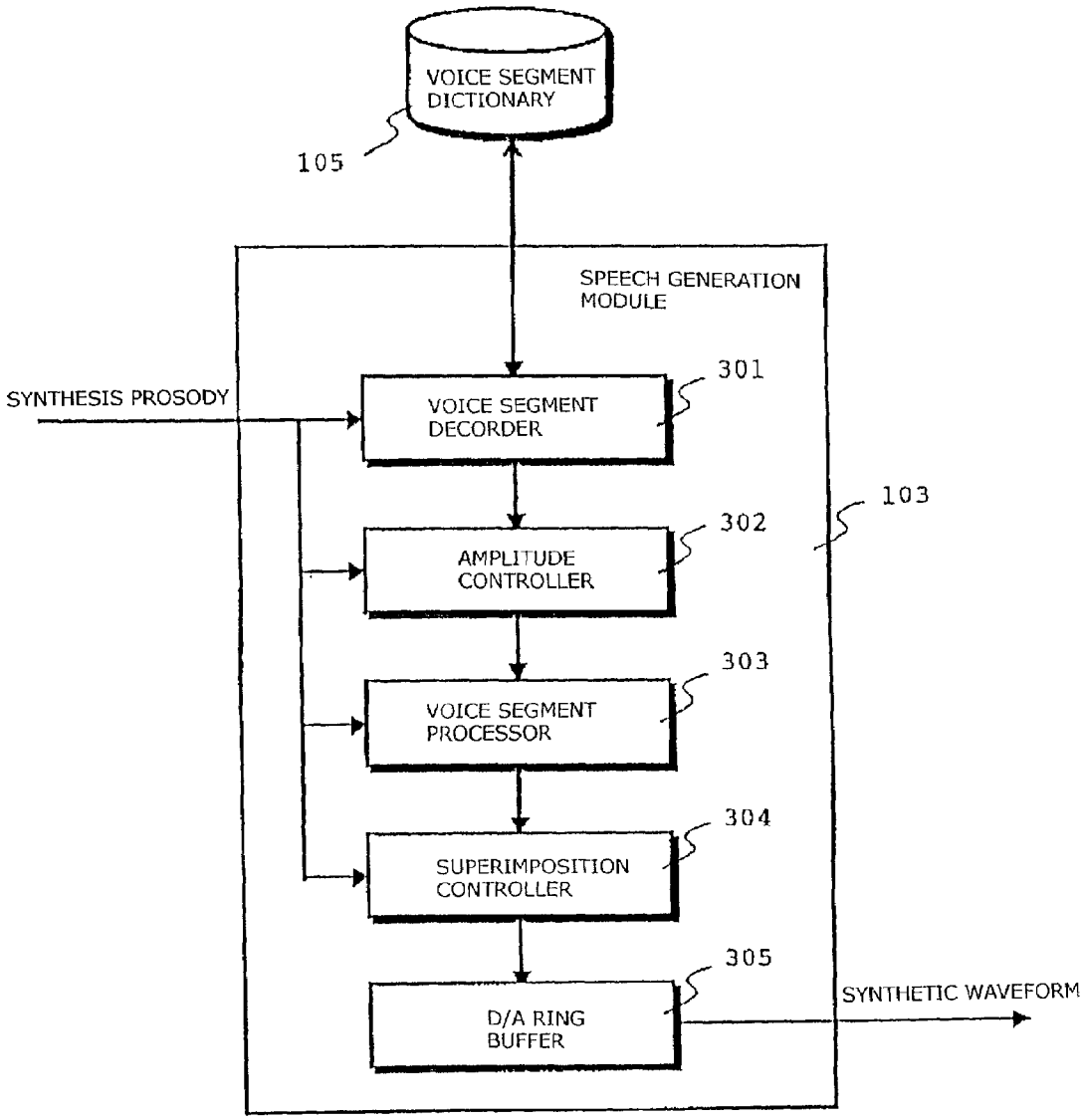
FIG. 19 PRIOR ART
FIG. 19 is a block diagram of a conventional speech generation module.
Figure 20:
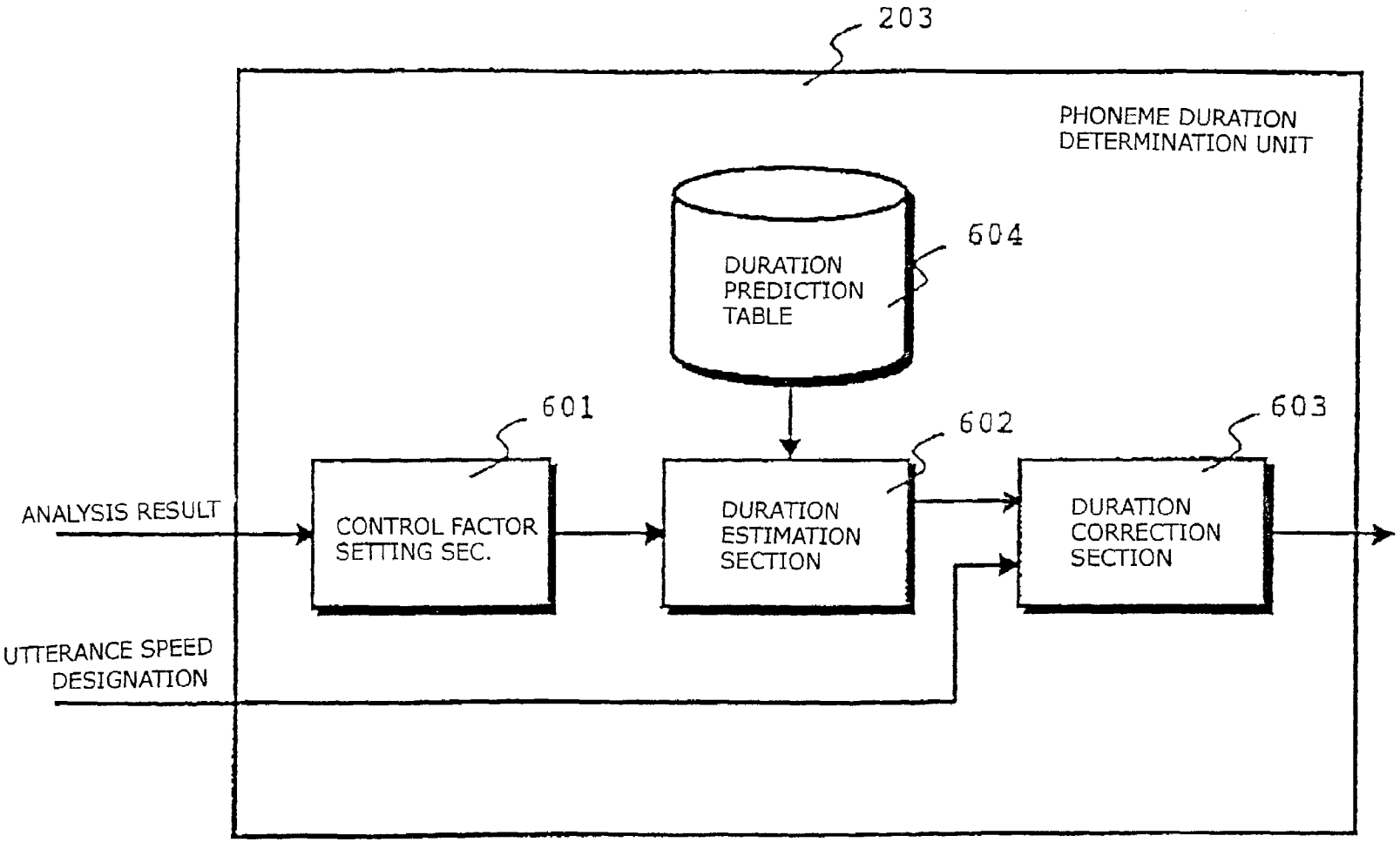
FIG. 20 PRIOR ART
FIG. 20 is a block diagram of a conventional phoneme duration determination unit.
Figure 21:
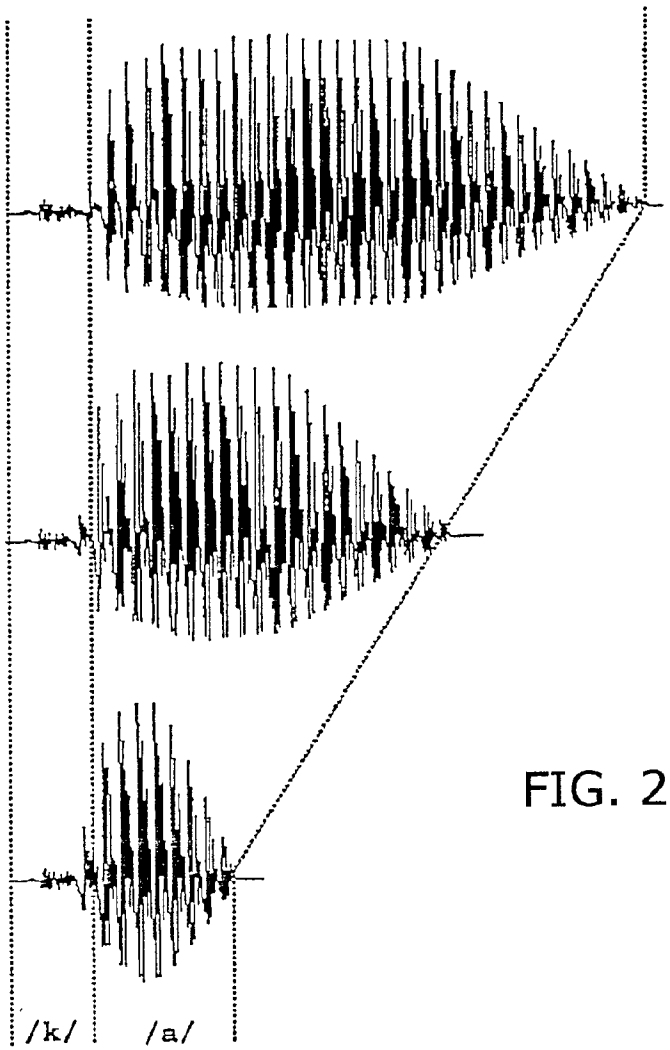
FIG. 21 is a graph of waveforms at different utterance speeds.

In FIG. 14, I is the number of words in the input sentence, Tci is the duration correction coefficient for the phoneme in the i-th word, lev is the utterance speed level designated by the user, T(n) is the expansion/compression coefficient at the utterance speed level n, Tij is the length of a j-th vowel in a i-th word, and J is the number of syllables which constitute a word.

In step ST201, the word counter i is initialized to 0. In ST202, the word number and the utterance speed level are determined. When the count of a word under process is 0 and the utterance speed level is 4, or the syllable under process belongs to the leading word in the sentence and the utterance speed is at the highest level, the process goes to ST204 and, otherwise, ST203. In ST204, the value at the utterance speed level 2 is selected as the correction coefficient and the process goes to ST205.

$$TC_i=T(2) \tag{5}$$

In ST203, the correction coefficient at the level designated by the user is selected and the process goes to ST205.

$$TC_i=T(\text{lev}) \tag{6}$$

In ST205, the syllable counter j is initialized to 0 and the process goes to ST206, in which the duration time, Tij, of the j-th vowel in the i-th word is determined by the following equation.

$$T_{ij}=T_{ij}\times TC_i \tag{7}$$

In ST207, the syllable counter j is incremented by one and the process goes to ST208, in which the syllable counter j is compared with the number of syllables J in the word. When the syllable counter j exceeds the number of syllables J, or all of the syllables in the word have been processed, the process goes to ST209. Otherwise, the process returns to ST206 to repeat the above process for syllable.

In ST209, the word counter i is incremented by one and the process goes to ST210, in which the word counter i is compared with the number of words I. When the word counter i exceeds the number of words I, or all of the words in the input sentence have been processed, the process is terminated and, otherwise, the process goes back to ST202 to repeat the above process for the next word.

By the above process, even if the utterance speed designated by the user is at the highest level, the leading ward in the sentence always is read at the normal utterance speed to generate a synthetic voice.

As has been described above, according to the fourth embodiment of the invention, when the utterance speed level is set at the maximum speed, the leading word of a sentence is process at the normal utterance speed so that it is easy to release FRF timely. In user's manuals or software specifications, for example, such a heading number as "Chapter 3" or "4.1.3." is used. Where it is desired to read such a manual from Chapter 3 or 4.1.3, it has been necessary for the convention to distinguish such key words as "chapter three" or "four period one period three" among the synthetic voices outputted at high speeds to release FRF. According to the fourth embodiment, it is easy to turn on or off FRF.

The invention is not limited to the above illustrated embodiments, and a variety of modifications may be made without departing from the sprit and scope of the invention.

In the first embodiment, for example, the simplification or termination of the function unit on which a large load is applied during the text-to-speech conversion process when the utterance speed is set at the maximum level may not be limited to the maximum utterance speed. That is, the above process may be modified for application only when the utterance speed exceeds a certain threshold. The heavy load processes are not limited to the phoneme parameter prediction by Quantification theory (type one) and the voice segment data process for sound quality conversion. Where there is another heavy load processing capability, such as an audio process of echoes or high pitch emphasis, it is preferred to simplify or invalidate such function. In the sound quality conversion process, the waveform may be expanded or compressed non-linearly or changed through the specified conversion function for the frequency parameter. As far as the calculation amount and process time are minimized, the rule making procedures are not limited to the phoneme duration and pitch contour determination rules. If the prosodic parameter prediction at the normal utterance speed by using statistic analysis involves more calculation load than the prediction by rule, the prediction may not be limited to the above process. The control factors described for the prediction are illustrative only.

In the second embodiment, the process by which the intonation component of a pitch contour is made 0 for pitch contour generation when the utterance speed is set at the maximum level, but such process may not be limited to the maximum utterance speed. That is, the process may be applied when the utterance speed exceeds a certain threshold. The intonation component may be made lower than the normal one. For example, when the utterance speed is set at the maximum level, the intonation designation level is forced to set at the lowest level to minimize the intonation component in the pitch contour correction unit. However, the intonation designation level at this point must be sufficient to provide an easy-to-listen intonation at the time of high-speed synthesis The accent and phrase components of a pitch contour may be determined by rule. The control factors described for making prediction are illustrative only.

In the third embodiment, the insertion of a signal sound between sentences may be made at utterance speeds other than the maximum speed. That is, the insertion may be made when the utterance speed exceeds a certain threshold. The signal sound may be generated by any technique as far as it attracts user's attention. The recorded sound effects may be output as they are. The signal sound dictionary may be replaced by an internal circuitry or program for generating them. The insertion of a signal sound may be made immediately before the synthetic waveform as far as the sentence boundary is clear at the maximum utterance speed. The kind of a signal sound inputted to the parameter generation unit may be omitted owing to the hardware or software limitation. However, it is preferred that the signal sound be changeable according to the user's preference.

In the fourth embodiment, the process of the phoneme duration control of the leading word at the normal (default) utterance speed may be made at other utterance speeds. That is, the above process may be made when the utterance speed exceeds a certain threshold. The unit process at the normal utterance speed may be the two leading words or phrases. Also, it may be made at a level one lower than the normal utterance speed.

As has been described above, according to an aspect of the invention, there is provided a method of controlling high-speed reading in a text-to-speech conversion system including a text analysis module for generating a phoneme and prosody character string from an input text; a prosody generation module for generating a synthesis parameter of at least a voice segment, a phoneme duration, and a fundamental frequency for the phoneme and prosody character string; a voice segment dictionary in which voice segments as a source of voice are registered; and a speech generation module for generating a synthetic waveform by waveform superimposition by referring to the voice segment dictionary, the method comprising the step of providing the prosody generation module with (1) a phoneme duration determination unit that includes both a duration rule table containing empirically found phoneme durations and a duration prediction table containing phoneme durations predicted by statistical analysis and determines a phoneme duration by using, when a user-designated utterance speed exceeds a threshold, the duration rule table and, when the threshold is not exceeded, the duration prediction table, (2) a pitch contour determination unit that has both an empirically found rule table and a prediction table predicted by statistical analysis and determines a pitch contour by determining both accent and phrase components with, when a user-designated utterance speed exceeds a threshold, the duration rule table and, when the threshold is not exceeded, the duration prediction table, or (3) a sound quality coefficient determination unit that has a sound quality conversion coefficient table for changing the voice segment to switch sound quality and selects from the sound quality conversion coefficient table such a coefficient that sound quality does not change when a user-designated utterance speed exceeds a threshold, thus simplifying or invalidating the function with a heavy process load in the text-to-speech conversion process to minimize the voice interruption due to the heavy load and generate an easy-to-understand speech even if the utterance speed is set at the maximum level.

According to another aspect of the invention, there is provided a method of controlling high-speed reading in a text-to-speech conversion system, comprising the step of providing the prosody generation module with both a pitch contour correction unit for outputting a pitch contour corrected according to an intonation level designated by the user and a switch for determining whether a base pitch is added to the pitch contour corrected according to the user-designated utterance speed such that when the utterance speed exceeds a predetermined threshold, the base pitch is not changed. Consequently, when the utterance speed is set at the predetermined maximum level, the intonation component of the pitch contour is made 0 to generate the pitch contour so that the intonation does not change at short cycles, thus avoiding synthesis of unintelligible speech.

According to still another aspect of the invention there is provided a method of controlling high-speed reading in a text-to-speech conversion system, comprising the step of providing the speech generation module with signal sound generation means for inserting a signal sound between sentences to indicate an end of a sentence when a user-designated utterance speed exceeds a threshold so that when the utterance speed is set at the maximum level, a signal sound is inserted between sentences to clarify the sentence boundary, making it easy to understand the synthetic speech.

According to yet another aspect of the invention there is provided a method of controlling high-speed reading in a text-to-speech conversion system, comprising the step of providing the prosody generation module with a phoneme duration determination unit for performing a process in which when a user-designated utterance speed exceeds a threshold, an utterance speed of at least a leading word in a sentence is returned to a normal utterance speed so that the utterance speed is at the maximum level, the leading word is processed at the normal utterance speed, making it easy to timely release the FRF operation.

The invention claimed is:

1. A method of controlling highspeed reading in a text-to-speech conversion system including a text analysis module for generating a phoneme and prosody character string from an input text; a prosody generation module for generating a synthesis parameter of at least a voice segment, a phoneme duration, and a fundamental frequency for the phoneme and prosody character string; a voice segment dictionary in which voice segments as a source of voice are registered; and a speech generation module for generating a synthetic waveform by waveform superimposition by referring to said voice segment dictionary, said method comprising the step of providing said prosody generation module with a sound quality coefficient determination unit that has a sound quality conversion coefficient table for changing said voice segment to switch sound quality and selects from said sound quality conversion coefficient table such a coefficient that sound quality does not change when a user-designated utterance speed exceeds a threshold.

2. The method according to claim 1, wherein said threshold is a predetermined maximum utterance speed.

3. A method of controlling high-speed reading in a text-to-speech conversion system including a text analysis module for generating a phoneme and prosody character string from an input text; a prosody generation module for generating a synthesis parameter of at least a voice segment, phoneme duration, and fundamental frequency for the phoneme and prosody character string; a voice segment dictionary in which voice segments as a source of voice are registered; and a speech generation module for generating a synthetic waveform by waveform superimposition by referring to said voice segment dictionary, said method comprising the step of providing said prosody generation module with both a pitch contour correction unit for outputting a pitch contour corrected according to an intonation level designated by the user and a switch for determining whether a base pitch is added to said pitch contour corrected according to said user-designated utterance speed, said switch being controlled not to change the base pitch when the utterance speed exceeds a threshold.

4. The method according to claim 3, wherein said threshold is a predetermined maximum utterance speed.

5. The method according to claim 3, wherein said pitch contour correction unit performs a pitch contour generation process that includes a phrase component calculation process in which all phrases of an input sentence are processed by calculating a phrase component by statistical analysis according to said user-designated utterance speed or making said phrase component zero and a process in which all words in said input sentence are processed by calculating an accent component by statistical analysis according to said user-designated utterance speed and either correcting said accent component according to said user designated intonation level or making said accent component zero.

6. A method of controlling high-speed reading in a text-to-speech conversion system including a text analysis module for generating a phoneme and prosody character string from an input text; a prosody generation module for generating a synthesis parameter of at least a voice segment, a phoneme duration, and a fundamental frequency for said phoneme and prosody character string; a voice segment dictionary in which voice segments as a source of voice are registered; and a speech generation module for generating a synthetic waveform by waveform superimposition while referring to said voice segment dictionary, said method comprising the step of providing said speech generation module with signal sound generation means for inserting a signal sound between sentences to indicate an end of a sentence when a user-designated utterance speed exceeds a threshold.

7. The method according to claim 3, wherein said threshold is a predetermined maximum utterance speed.

8. A method of controlling highspeed reading in a text-to-speech conversion system including a text analysis module for generating a phoneme and prosody character string from an input text; a prosody generation module for generating a synthesis parameter of at least a voice segment, a phoneme duration, and a fundamental frequency for the phoneme and prosody character string; a voice segment dictionary in which voice segments as a source of voice are registered; and a speech generation module for generating a synthetic waveform by waveform superimposition by referring to said voice segment dictionary, said method comprising the step of providing said prosody generation module with a phoneme duration determination unit for performing a process in which when a user-designated utterance speed exceeds a threshold, an utterance speed of at least a leading word in a sentence is returned to a normal utterance speed.

9. The method according to claim 8, wherein said threshold is a predetermined maximum utterance speed.

10. The method according to claim 8, wherein said phoneme duration determination unit performs a process in which when a word under process is a leading word in a sentence and said user-designated utterance speed exceeds said threshold, a phoneme duration is not corrected and, when said word under process is not a leading word of a sentence or said user-designated utterance speed does not exceed said threshold, a first process by which a phoneme duration correction coefficient is changed according to said user-designated utterance speed and a second process in which all syllables of said word are processed by correcting a length of a vowel or vowels of said word, and carrying out said first and second processes for all words contained in the sentence.

11. A method of controlling high-speed reading in a text-to-speech conversion system, comprising:

inputting a text into the text-to-speech conversion system;

generating a phoneme and prosody character string of the text with a text analysis module;

creating a duration rule table containing a first phoneme duration obtained empirically;

creating a duration prediction table containing a second phoneme duration obtained through statistical analysis;

designating an utterance speed;

determining a threshold value;

comparing the utterance speed with the threshold value;

selecting one of the duration rule table and the duration prediction table according to the utterance speed;

determining a third phoneme duration with a phoneme duration determination unit according to the one of the duration rule table and the duration prediction table;

generating a synthesis parameter of at least a voice segment, the third phoneme duration, and a fundamental frequency of the phoneme and prosody character string with a prosody generation module; and generating a synthetic waveform through waveform superimposition with a speech generation module according to the synthesis parameter and a voice segment dictionary containing a voice segment as a basic source of voice.

12. The method according to claim 11, in the step of selecting the one of the duration rule table and the duration prediction table according to the utterance speed, said duration rule table is selected when the utterance speed exceeds the threshold value, and said duration prediction table is selected when the utterance speed does not exceed the threshold value.

13. The method according to claim 11, in the step of determining the threshold value, said threshold value is determined to be a predetermined maximum utterance speed.

14. A method of controlling high-speed reading in a text-to-speech conversion system, comprising:

inputting a text into the text-to-speech conversion system;

generating a phoneme and prosody character string of the text with a text analysis module;

creating a rule table containing first data of accent and phrase components obtained empirically;

creating a prediction table containing second data of accent and phrase components obtained through statistical analysis;

designating an utterance speed;

determining a threshold value;

comparing the utterance speed with the threshold value;

selecting one of the rule table and the prediction table according to the utterance speed;

determining a pitch contour with a pitch contour determination unit according to the one of the rule table and the prediction table;

generating a synthesis parameter of at least a voice segment, a phoneme duration, and a fundamental frequency of the phoneme and prosody character string with a prosody generation module; and generating a synthetic waveform through waveform superimposition with a speech generation module according to the synthesis parameter and a voice segment dictionary containing a voice segment as a basic source of voice.

15. The method according to claim 14, in the step of selecting the one of the rule table and the prediction table according to the utterance speed, said rule table is selected when the utterance speed exceeds the threshold value, and said prediction table is selected when the utterance speed does not exceed the threshold value.

16. The method according to claim 14, in the step of determining the threshold value, said threshold value is determined to be a predetermined maximum utterance speed.

* * * * *